US012416465B1

(12) United States Patent
Campbell

(10) Patent No.: US 12,416,465 B1
(45) Date of Patent: Sep. 16, 2025

(54) MAGAZINE AND ADAPTOR FOR PAINTBALL MARKER

(71) Applicant: Robert Scott Campbell, St. Louis, MO (US)

(72) Inventor: Robert Scott Campbell, St. Louis, MO (US)

( * ) Notice: Subject to any disclaimer, the term of this patent is extended or adjusted under 35 U.S.C. 154(b) by 152 days.

(21) Appl. No.: 18/198,370

(22) Filed: May 17, 2023

Related U.S. Application Data

(60) Provisional application No. 63/349,170, filed on Jun. 6, 2022.

(51) Int. Cl.

| | |
|---|---|
| ***F41B 11/50*** | (2013.01) |
| ***F41B 11/52*** | (2013.01) |
| ***F41B 11/55*** | (2013.01) |
| *F41B 11/89* | (2013.01) |

(52) U.S. Cl.
CPC ..... *F41B 11/55* (2013.01); *F41B 11/50* (2013.01); *F41B 11/52* (2013.01); *F41B 11/89* (2013.01)

(58) Field of Classification Search
CPC ..... F41B 11/55; F41B 11/50; F41B 11/52; F41B 11/89
See application file for complete search history.

(56) References Cited

U.S. PATENT DOCUMENTS

| | | | | |
|---|---|---|---|---|
| 5,809,983 | A * | 9/1998 | Stoneking | F41A 9/82 124/45 |
| 8,966,801 | B1 * | 3/2015 | Bentley | F41B 11/55 42/50 |
| 2006/0180134 | A1 * | 8/2006 | Illuzzi | F41A 9/24 102/502 |
| 2011/0226226 | A1 * | 9/2011 | Isabelle | F41B 11/52 124/80 |
| 2011/0271941 | A1 * | 11/2011 | Meggs | F41B 11/89 124/31 |
| 2014/0096755 | A1 * | 4/2014 | Larmer | F41B 11/55 124/52 |
| 2015/0027426 | A1 * | 1/2015 | Isabelle | F41B 11/52 124/80 |
| 2018/0045482 | A1 * | 2/2018 | Chong | F41B 11/51 |
| 2020/0300575 | A1 * | 9/2020 | Zuo | A63H 33/18 |
| 2022/0128329 | A1 * | 4/2022 | Buckmaster | F41B 11/55 |

* cited by examiner

*Primary Examiner* — John E Simms, Jr.
(74) *Attorney, Agent, or Firm* — Polsinelli PC

(57) ABSTRACT

A magazine and a magazine adaptor are described for use with a paintball marker. The paintball marker may include paintball guns and other paintball weapons. The magazine holds paintballs loose in an interior of the magazine for storage, transportation, etc. When the magazine is engaged to the magazine adaptor, a spring-loaded follower places tension on the paintballs. The tension helps to feed the paintballs to the paintball marker in a rapid manner.

25 Claims, 20 Drawing Sheets

MAGAZINE AND ADAPTOR FOR PAINTBALL MARKER

The present application claims priority U.S. Provisional Patent Application No.

63/349,170, filed Jun. 6, 2022.

FIELD OF INVENTION

The present invention relates to a magazine and adaptor to supply paintballs to a paintball marker or gun.

BACKGROUND OF INVENTION

Paintballs are often held in "pods" which provide a reservoir that holds the paintballs. Paintballs are loaded into "hoppers" that are attached to a paintball marker or gun. The hopper engages to the paintball marker and feeds the paintballs to the marker. Pods and hoppers include an open interior in which the paintballs may move around, spin, rotate, etc. to prevent dimpling, deformation, and/or flat spots on the paintballs. During prolonged storage of paintballs in pods or hoppers, dimpling, deformation, and/or flat spots on the paintballs often occur-particularly when the paintballs rest on top of each other. This is a common problem for paintballs, and a container or package holding the paintballs is often moved or rotated to prevent such deformation.

Paintballs are also held in magazines with spring loading features. Such magazines direct the paintballs to the marker in a rapid manner, however, paintballs stored in such magazines may be subject to the above-described deformation from the tension placed on the paintballs by the spring loading features. And, even if the tension on the paintballs is released when the magazine is not engaged to the marker, the paintballs are still not free to move or rotate to prevent such deformation.

SUMMARY OF INVENTION

A magazine and an adaptor to supply paintballs to a paintball marker or paintball gun is described. The magazine is configured to hold paintballs loose in an interior of the magazine for storage, transportation, etc. The adaptor is configured to engage to the paintball marker or paintball gun. When the magazine is engaged to the adaptor, tension is placed on the paintballs. The tension helps to feed or direct the paintballs to the paintball marker or gun in a rapid manner. However, when the magazine is not engaged, the paintballs are held loose and horizontally in the magazine in a wide well or chamber and are able to roll freely to avoid dimpling. The magazine serves as a horizontal pod when not engaged to the marker, but the magazine converts to a direct-feed magazine when engaged to the marker. Additionally, when the magazine is engaged, it feeds the paintballs in a wider, "zig-zag" pattern in the magazine chamber to an entry point that funnels the paintballs into the marker, enabling the magazine to rapidly move the paintballs into the marker. The wide well or chamber enables the magazine to allow the paintballs to roll and rotate loosely when the magazine is not engaged, but immediately place tension on the paintballs and assemble them in a double-stack, alternating, "zig-zag" pattern when engaged to the marker. The unique configuration prevents deformation of the paintballs until the magazine is engaged, at which time the paintballs are moved rapidly into the marker.

In one aspect, a magazine and adaptor for a paintball marker is described. The magazine is configured to hold paintballs. An adaptor is configured to engage to a paintball marker. The magazine is configured to engage to the adaptor. The magazine includes a spring-loaded follower. The spring-loaded follower includes a locked configuration and an unlocked configuration. In the locked configuration, the spring-loaded follower is fixed in a position relative to the magazine. In the unlocked configuration, the spring-loaded follower is configured to move relative to the magazine. An engagement of the magazine in the locked configuration to the adaptor transitions the spring-loaded follower to the unlocked configuration.

In another aspect, a magazine and adaptor for a paintball marker is described. The magazine is configured to hold paintballs. An adaptor is configured to engage to a paintball marker. The magazine is configured to engage to the adaptor. The magazine includes a loose configuration and a biased configuration, wherein in the loose configuration, the paintballs are free to move or rotate in an interior of the magazine, and wherein in the biased configuration, the paintballs are urged towards an exit opening of the magazine.

In another aspect, a magazine and adaptor for a paintball marker is described. The magazine is configured to hold paintballs. The adaptor is configured to engage to a paintball marker. The magazine is configured to engage to the adaptor. The magazine includes a spring-loaded follower and a switch configured to release the spring-loaded follower. The adaptor includes a knob extending from an upper surface of the adaptor. The knob is configured to engage the switch when the magazine is engaged to the adaptor.

In another aspect, a magazine for a paintball marker is described. The magazine includes an interior configured to hold paintballs. An opening is at a front of the interior. A spring-loaded follower is positioned at least partially in the interior. The spring-loaded follower is configured to move in the interior toward the opening. A spring-loaded pin is engaged to the magazine. The spring-loaded pin is configured to hold and release the spring-loaded follower at a rear of the interior. A release switch is configured to actuate the spring-loaded pin to release the spring-loaded follower.

DETAILED DESCRIPTION

Figure 1A:
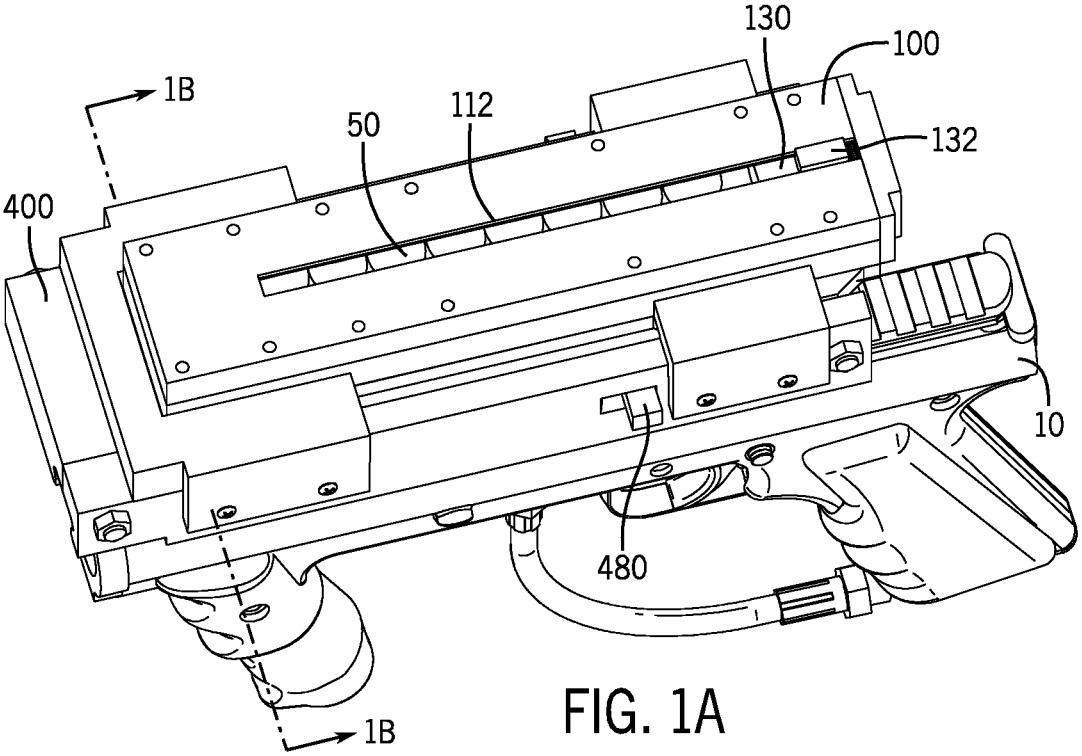
FIG. 1A is a perspective view of the magazine and adaptor engaged to the marker.

For purposes of this application, any terms that describe relative position (e.g., "upper", "middle", "lower", "outer", "inner", "above", "below", "bottom", "top", etc.) refer to an embodiment of the invention as illustrated, but those terms do not limit the orientation in which the embodiments can be used. With respect to FIGS. 1-30, a magazine 100 and a magazine adaptor 400 are described for use with a paintball marker 10. The paintball marker 10 may include paintball guns and other paintball weapons of all types. The adaptor 400 is configured to removably engage to the paintball marker 10. The magazine 100 is configured to removably engage to the adaptor 400.

The magazine 100 is configured to holds paintballs 50 loose in the magazine 100 in a wide well or chamber for storage, transportation, etc. When the magazine 100 is engaged to the magazine adaptor 400, tension is placed on the paintballs 50. The tension helps to feed the paintballs 50 to the paintball marker 10 in a rapid manner.

The magazine 100 provides dual holding configurations. The magazine 100 provides a first tensioned or biased configuration and a second loose configuration. In the loose configuration, the magazine 100 acts as a pod in which paintballs 50 are free to move around, spin, rotate, etc. within a wide interior 105 of the magazine 100 to prevent dimpling or other deformation. When the magazine 100 is engaged in the adaptor 400, a spring-loaded follower 130 may be released to place pressure on the paintballs 50 to feed them into the marker 10 in a rapid manner. The spring-loaded follower 130 immediately assembles the paintballs 50 in a "zig-zag" pattern within the chamber of the magazine 100 and funnels them rapidly into the marker 10, enabling the magazine 100 to rapidly move the paintballs 50 into the marker 10. This increases rapid-fire capability for the paintball marker 10 and loading reliability. Prior to engaging the magazine 100 to the adaptor 400, the spring-loaded follower 130 may remain locked and place no pressure on the paintballs 50. This renders the magazine as a "pod" which can store the paintballs 50 without causing dimples or deformation.

Figure 7:
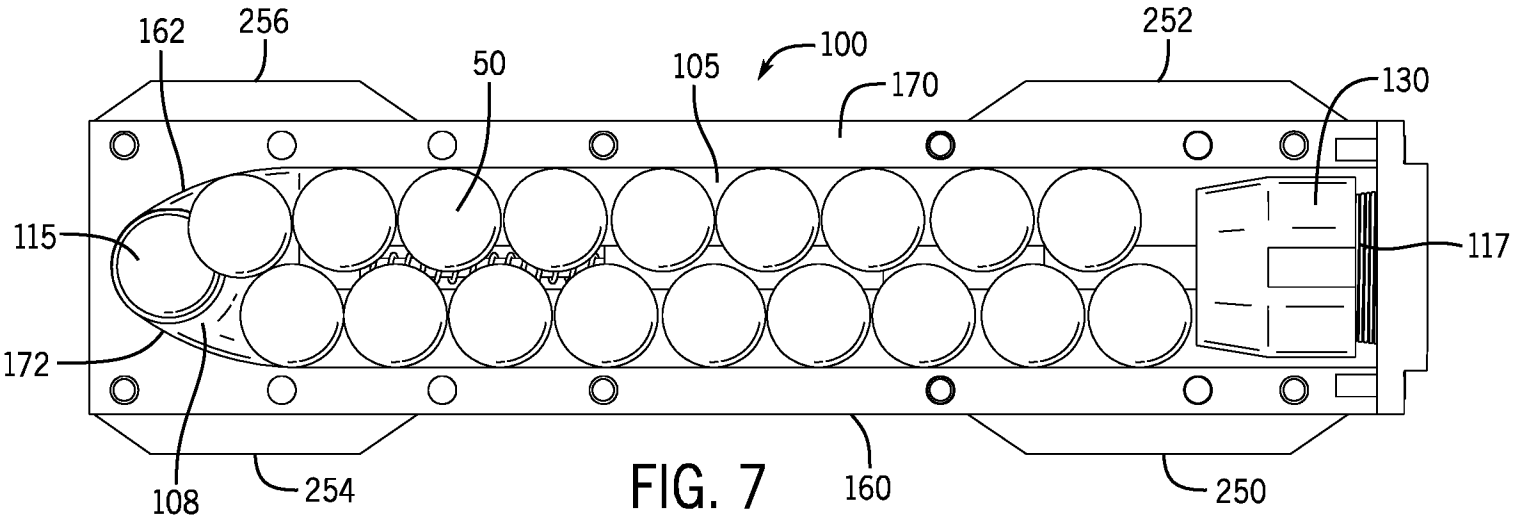
FIG. 7 is a top view of the magazine.
Figure 8:
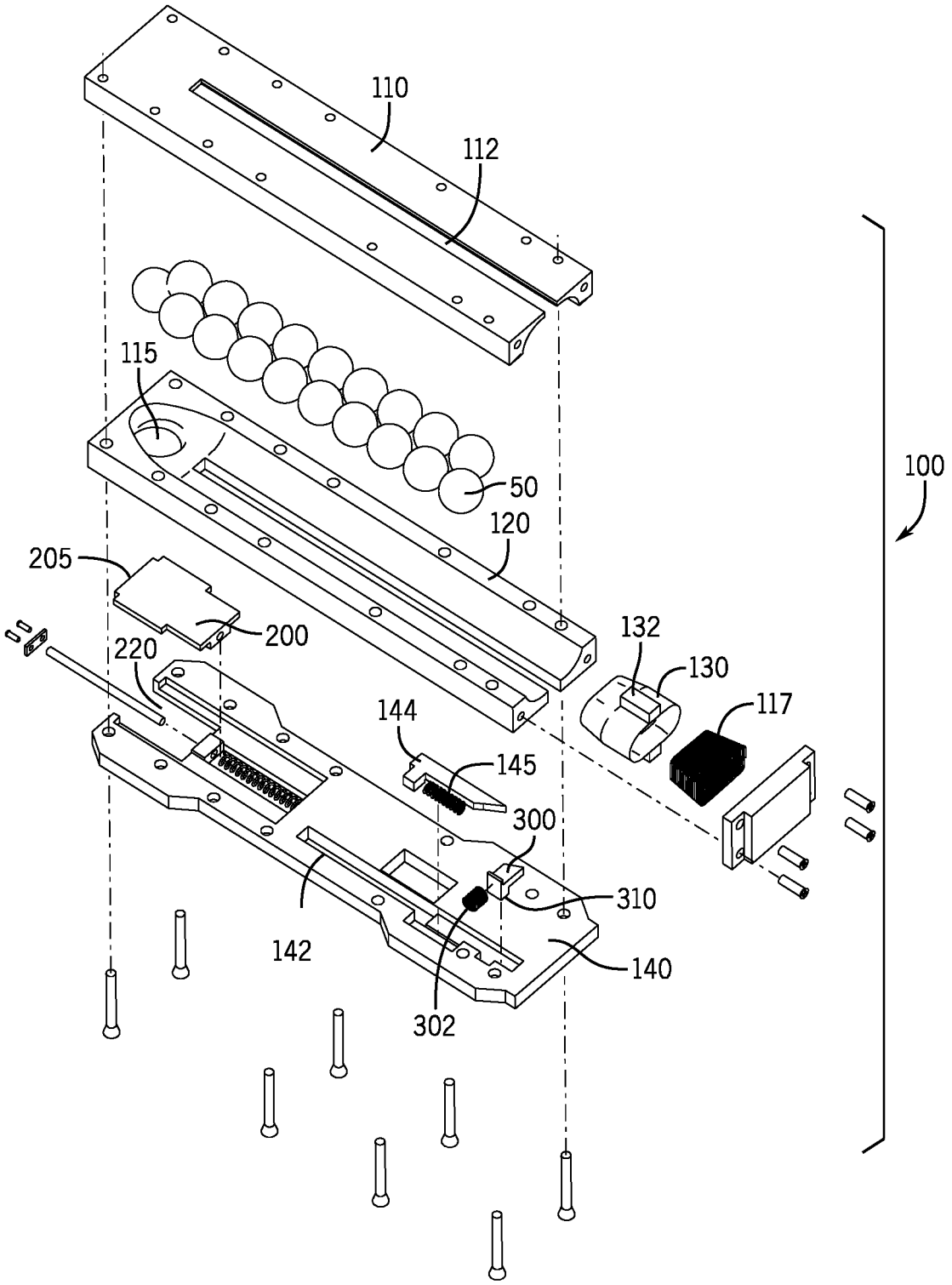
FIG. 8 is an exploded view of the magazine.

With respect to FIG. 7, the magazine 100 includes a magazine well 108 that loads the paintballs 50 in a double-stack, alternating, "zig-zag" pattern. This increases the number of paintballs 50 that can be loaded and held in a given length of the magazine 100. It also enables the paintballs 50 to roll and rotate freely in the wider chamber of the magazine 100, preventing dimpling and deformation. In various aspects, the magazine 100 may be dimensioned to operate with different paintball markers 10 or hold different amounts of the paintballs 50.

Figure 10:
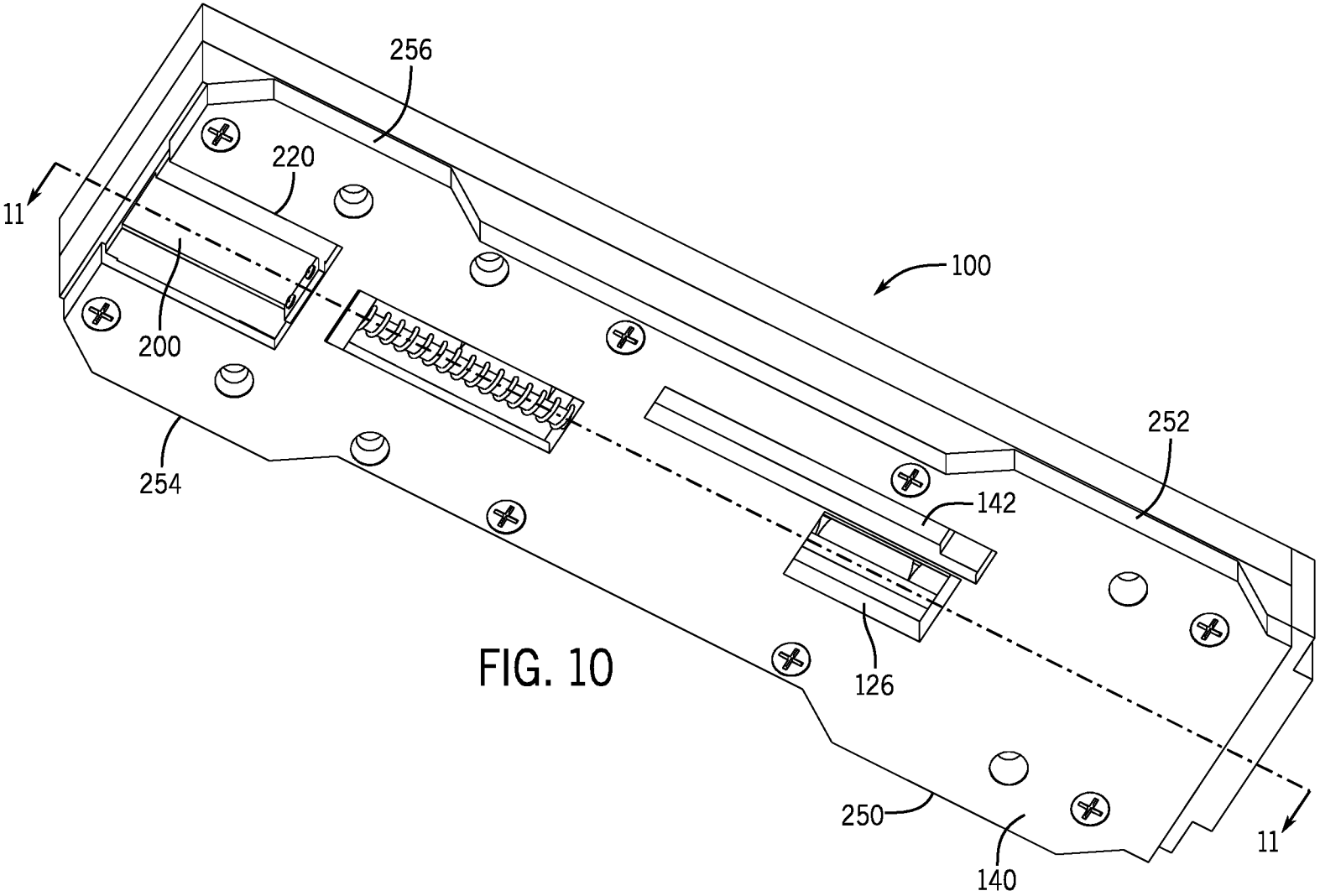
FIG. 10 is a lower view of the magazine.
Figure 11:
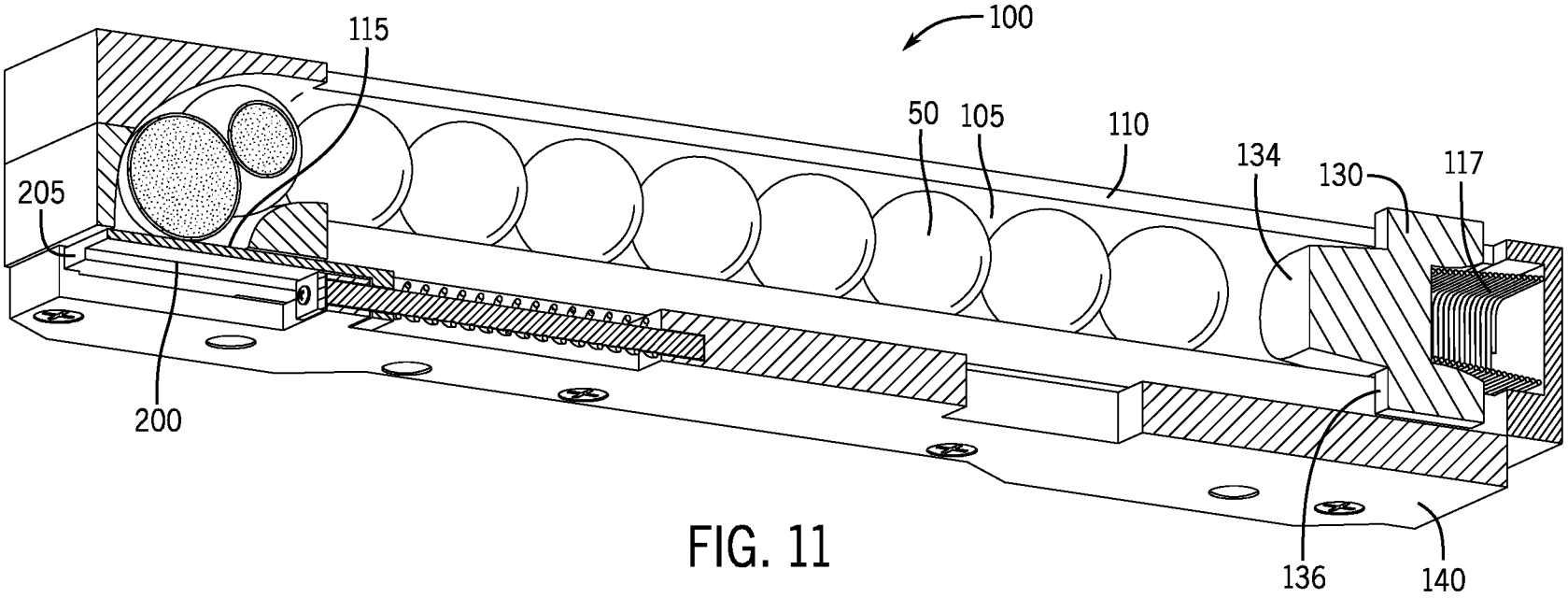
FIG. 11 is a sectional view of the magazine.
Figure 12:
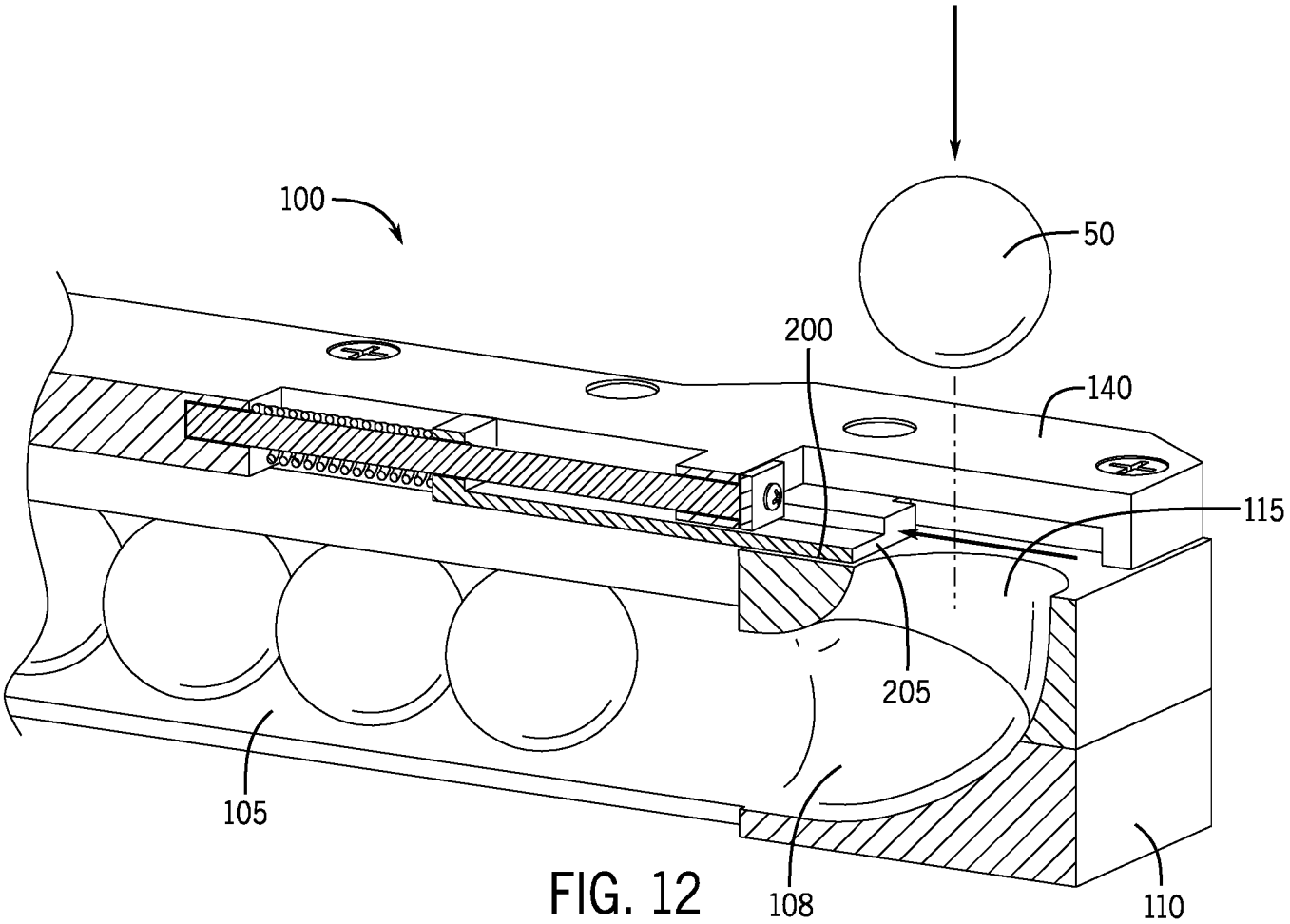
FIG. 12 is a sectional view of the magazine.
Figure 13:
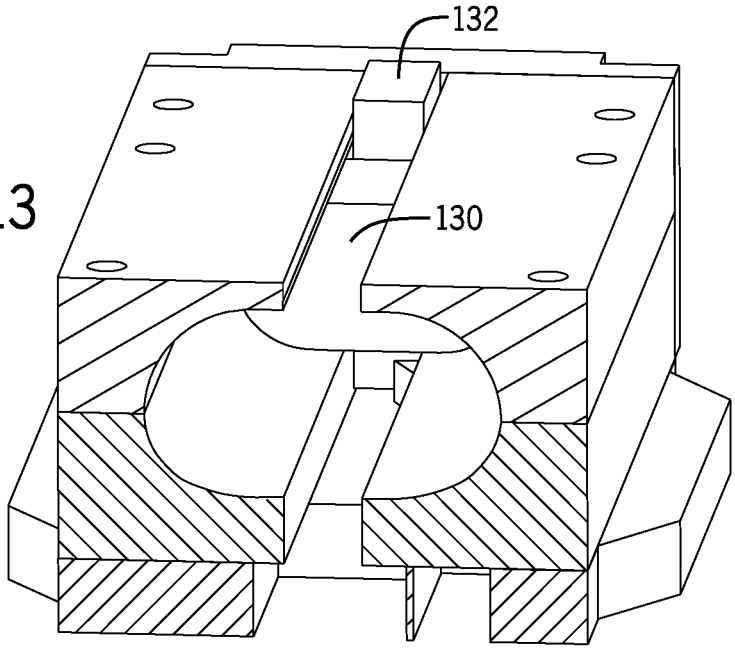
FIG. 13 is a sectional view of the magazine.

With respect to FIG. 10, the magazine 100 includes a sliding door 200 to retain the paintballs 50 in the interior 105 of the magazine 100. The magazine 100 is configured to retract relative to the magazine 100 to cover and uncover the opening 115. In a closed position, the sliding door 200 covers an opening 115 of the magazine 100. In an open position, the sliding door 200 does not cover the opening 115. The sliding door 200 is opened when the magazine 100 is engaged to the adaptor 400. The sliding door 200 is also opened manually for loading the paintballs 50 into the magazine 100 by depressing the sliding door 200. However, in this aspect, the sliding door 200 is configured to automatically close when the magazine 100 is removed from the adaptor 400, thereby keeping the paintballs 50 in the magazine 100.

The magazine 100 includes the spring-loaded follower 130 that feeds the paintballs 50 to the marker 10 at a rapid pace. The spring-loaded follower 130 travels in the interior 105 of the magazine 100 and is biased toward a front of magazine 100. In the loose configuration of the magazine 100, the spring-loaded follower 130 may be locked at a rear of the magazine 100.

A front portion of the magazine well 108 (at the point of entry into the paintball marker 10) is horizontally contoured to funnel paintballs 50 into the marker 10 at a rapid pace in an alternating, zig-zag pattern. This enables the magazine 100 to feed a higher quantity of paintballs 50 into the marker 10 than can be fed from a standard, "straight-line" magazine. The horizontally contoured nature of the magazine well 108 provides a feed slope that causes the double-stacked paintballs 50 to become a single stack at the opening 115.

Figure 9:
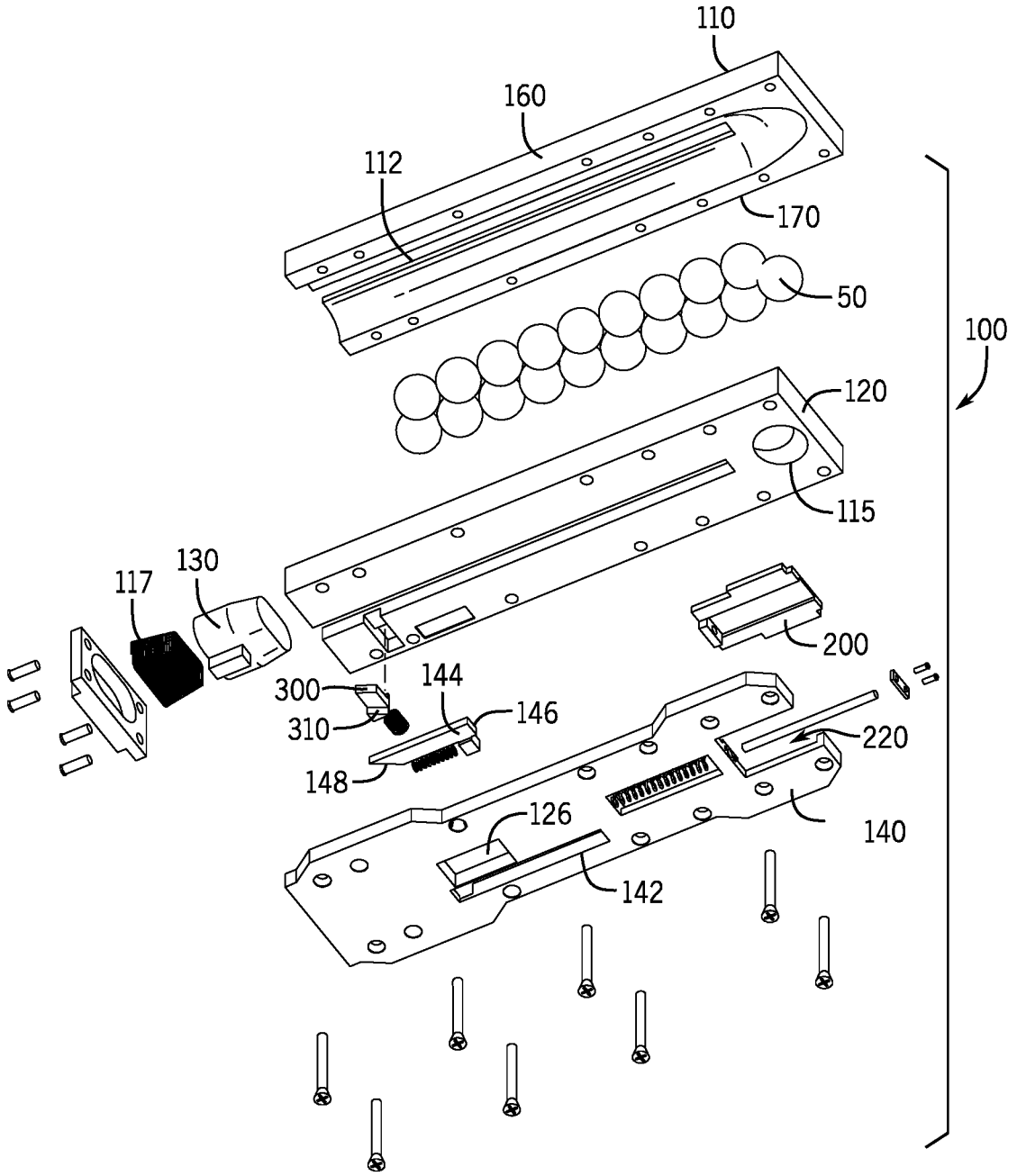
FIG. 9 is an exploded view of the magazine.

With respect to FIG. 9, the magazine 100 includes an upper wall 110 that is generally opposite of middle wall 120. The upper wall 110 includes a slot 112 generally parallel to a length of the magazine 100. The slot 112 provides a track for an upper tab 132 of the spring-loaded follower 130. The user may press against the upper tab 132 in order to retract or move the spring-loaded follower 130 to the locked position. The slot 112 also provides a visual confirmation to the user of the amount of paintballs 50 that are contained in the magazine 100. The position of the upper tab 132 also provides visual confirmation as whether the paintballs 50 are held in the biased configuration or the loose configuration.

With respect to FIGS. 23-26, when the magazine 100 is engaged to the adaptor 400, the sliding door 200 is urged to an open position to allow the paintballs 50 to flow from the magazine 100 into the adaptor 400. At the same time, the spring-loaded follower 130 unlocked, and the spring-loaded follower 130 biases against the paintballs 50 to drive them forward to the opening 115. The sliding door 200 is positioned in a recess 220 of the lower wall 140. The sliding door 200 travels generally parallel to the length of the magazine 100. The sliding door 200 opens and closes the opening 115 of the magazine 100.

Figure 14:
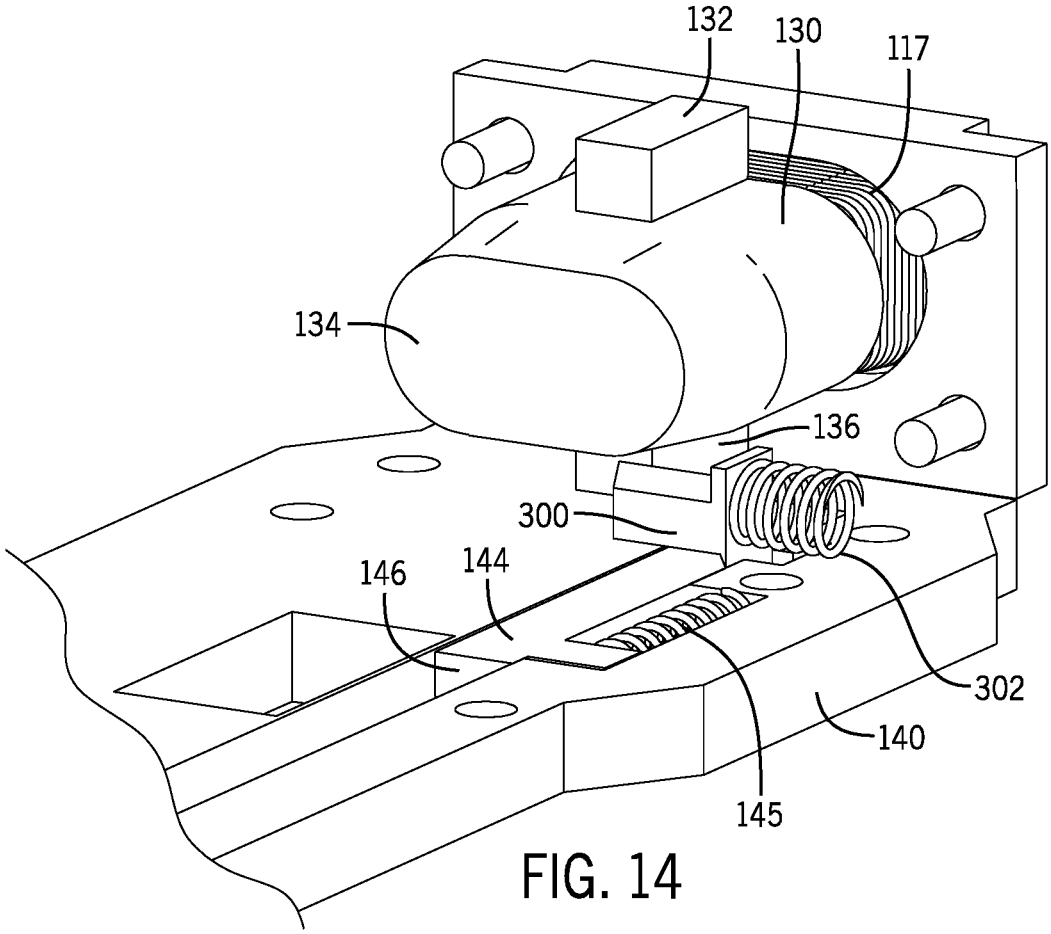
FIG. 14 is a perspective view of the magazine showing the spring-loaded follower.
Figure 15:
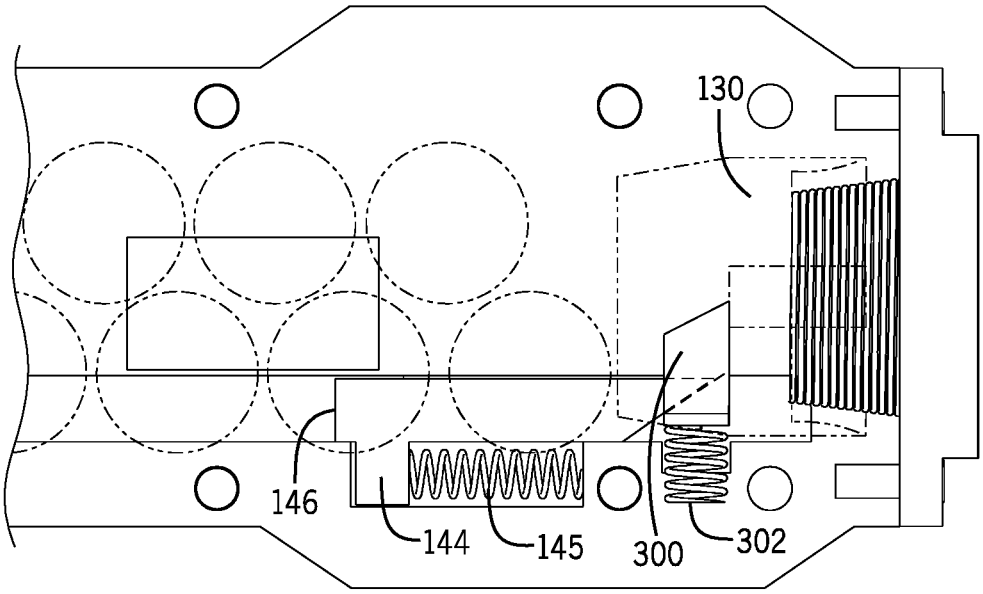
FIG. 15 is a view of the magazine showing the spring-loaded follower in the locked configuration.
Figure 16:
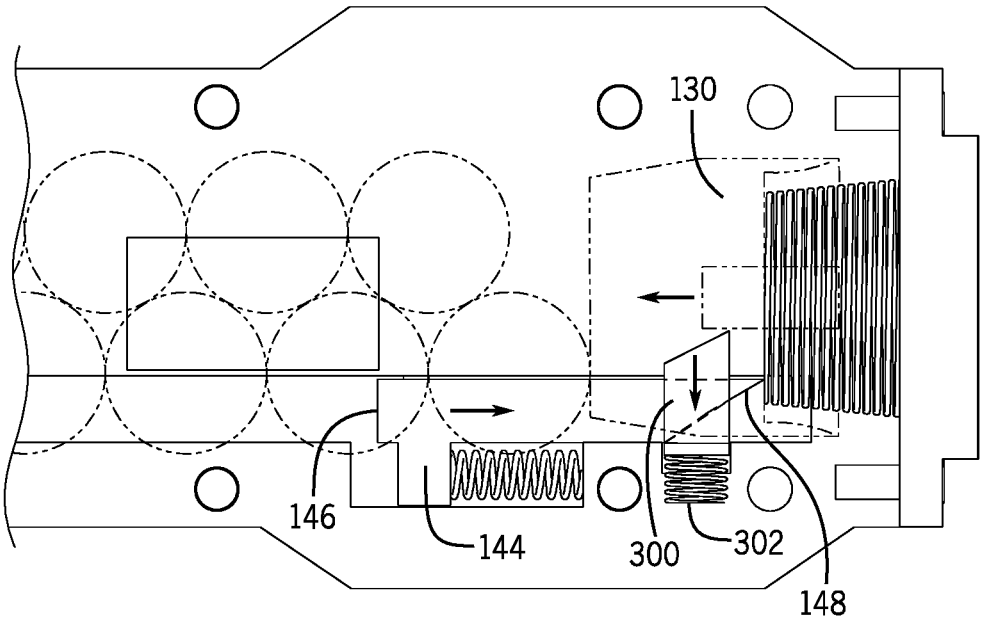
FIG. 16 is a view of the magazine showing the spring-loaded follower in the unlocked configuration.

With respect to FIG. 14, in this aspect, the spring-loaded follower 130 includes a contact surface 134 that directly contacts the paintballs 50 and pushes the paintballs 50 toward the opening 115. In this aspect, the spring-loaded follower 130 includes a coil spring 117 to provide bias to the spring-loaded follower 130. In other aspects, different biassing members may be used to drive or urge the contact surface 134 against the paintballs 50.

The spring-loaded follower 130 includes the locked and unlocked configurations. In the locked configuration, the spring-loaded follower 130 is fixed in a position relative to the magazine 100, and the paintballs 50 are free to rotate, spin, and move. In the unlocked configuration, the spring-loaded follower 130 is configured to move relative to the magazine 100 under the bias of the coil spring 117 and urge the paintballs 50 towards the opening 115 of the magazine 100.

The adaptor 400 includes an exit opening 500. In this aspect, the exit opening 500 is located at a lower lateral side of the adaptor 400. The exit opening 500 is positioned proximate a loading opening 12 of the paintball marker 10 such that paintballs 50 flow from the exit opening 500 of the adaptor 400 to the loading opening 12 of the paintball marker 10.

Figure 1B:
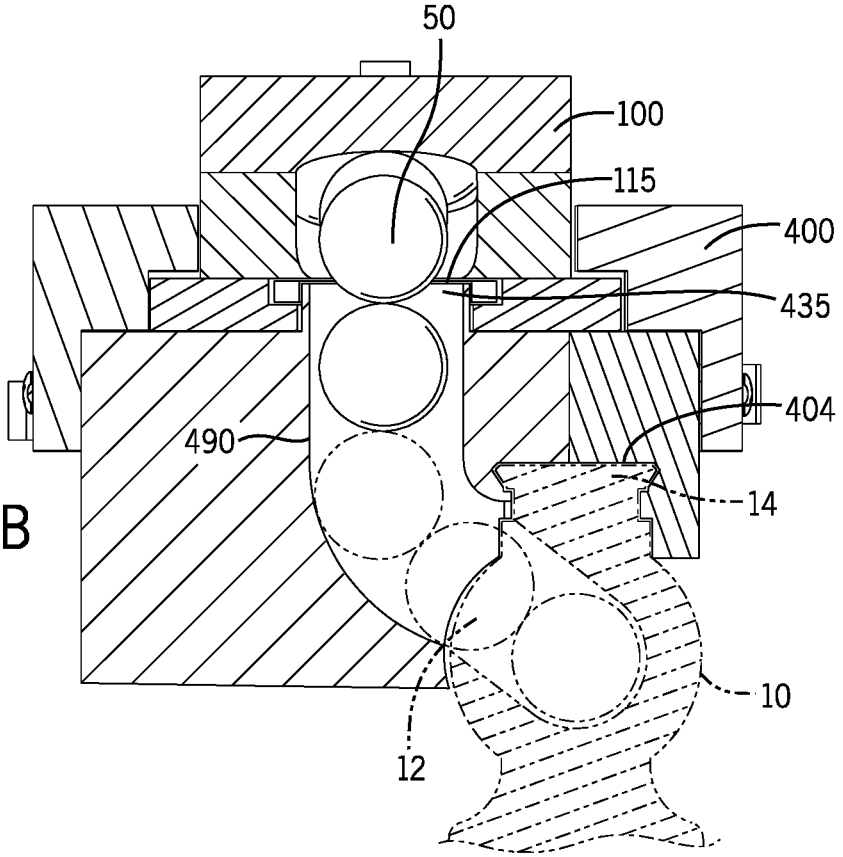
FIG. 1B is a sectional view of the magazine and adaptor engaged to the marker.
Figure 2:
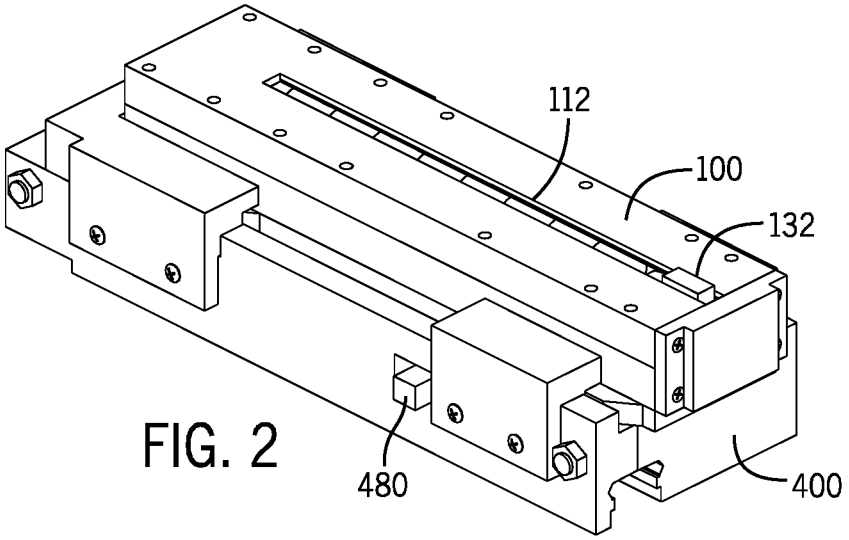
FIG. 2 is a perspective view of the magazine engaged to the adaptor.
Figure 3:
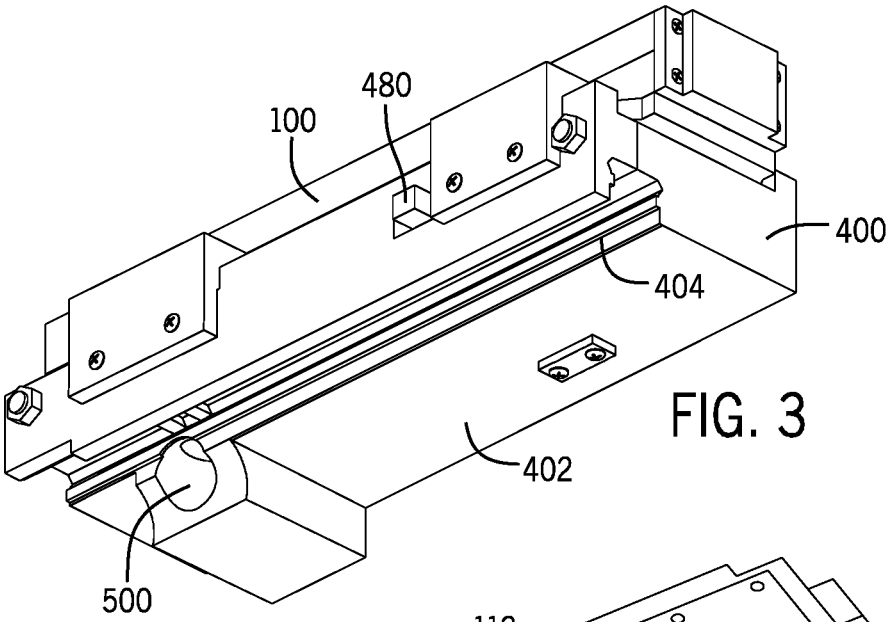
FIG. 3 is a lower perspective view of the magazine engaged to the adaptor.
Figure 4:
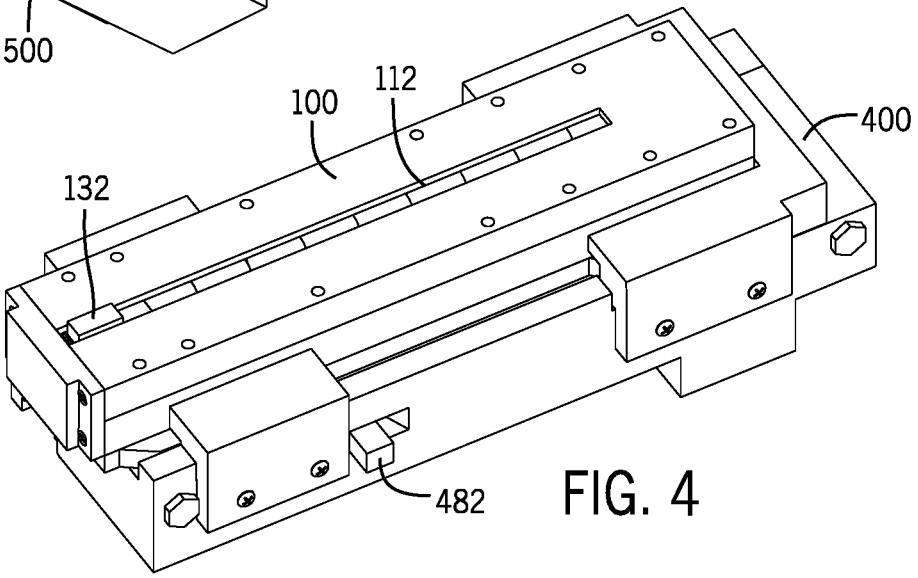
FIG. 4 is a perspective view of the magazine engaged to the adaptor.
Figure 5:
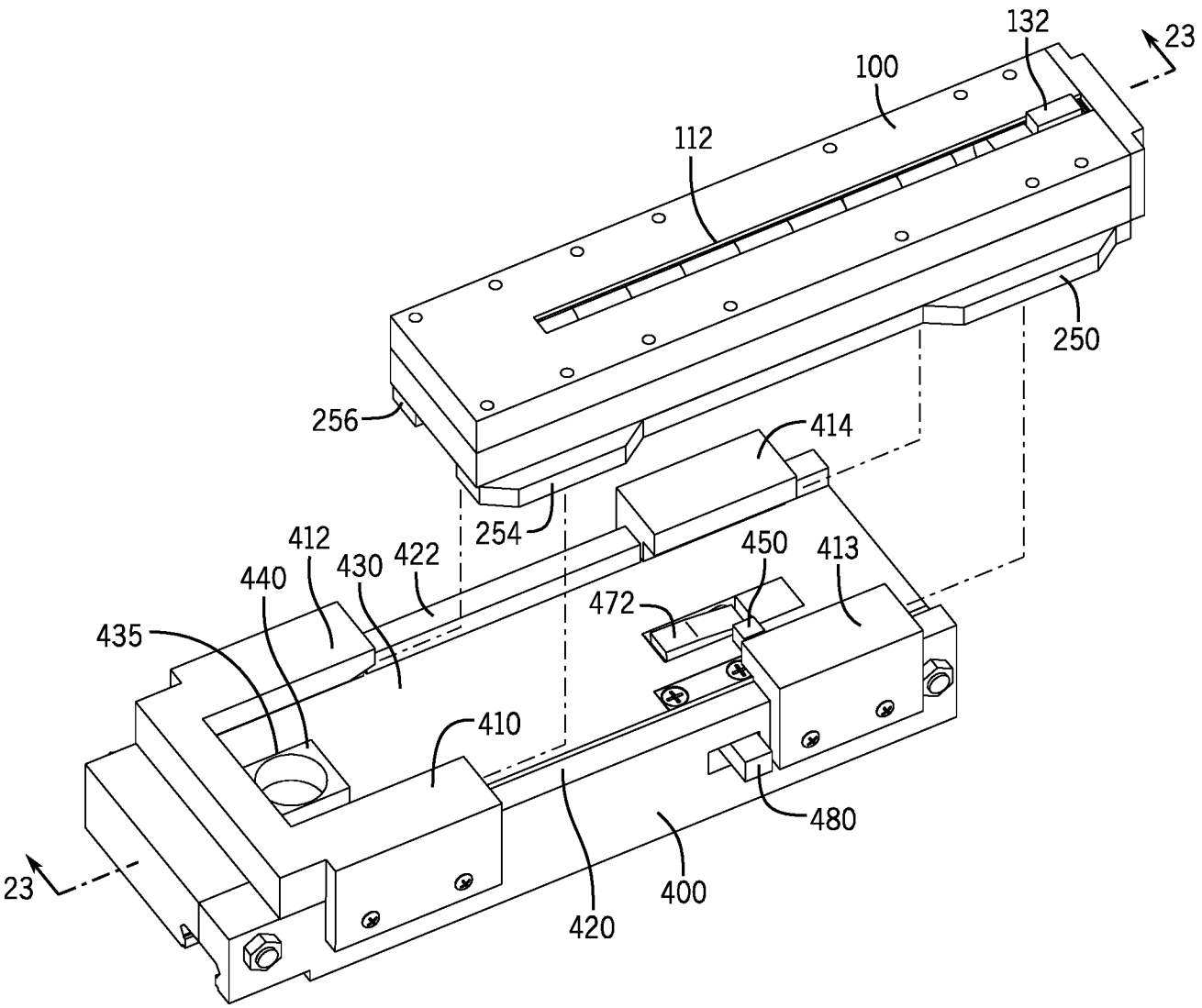
FIG. 5 is a perspective view of the magazine engaging to the adaptor.
Figure 6:
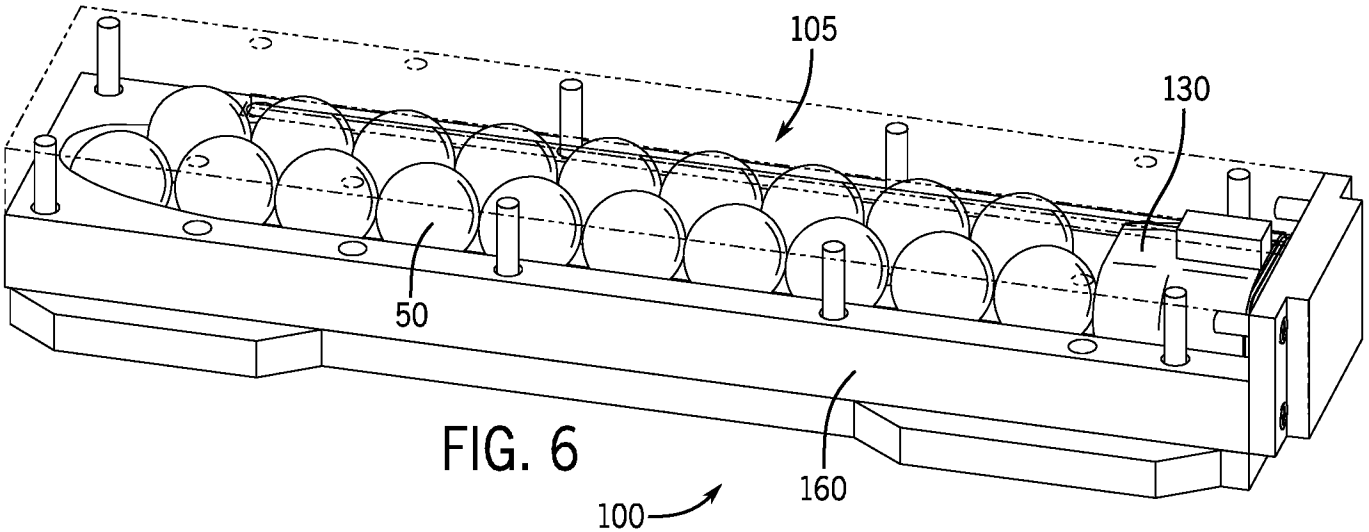
FIG. 6 is a perspective view of the magazine.
Figure 17:
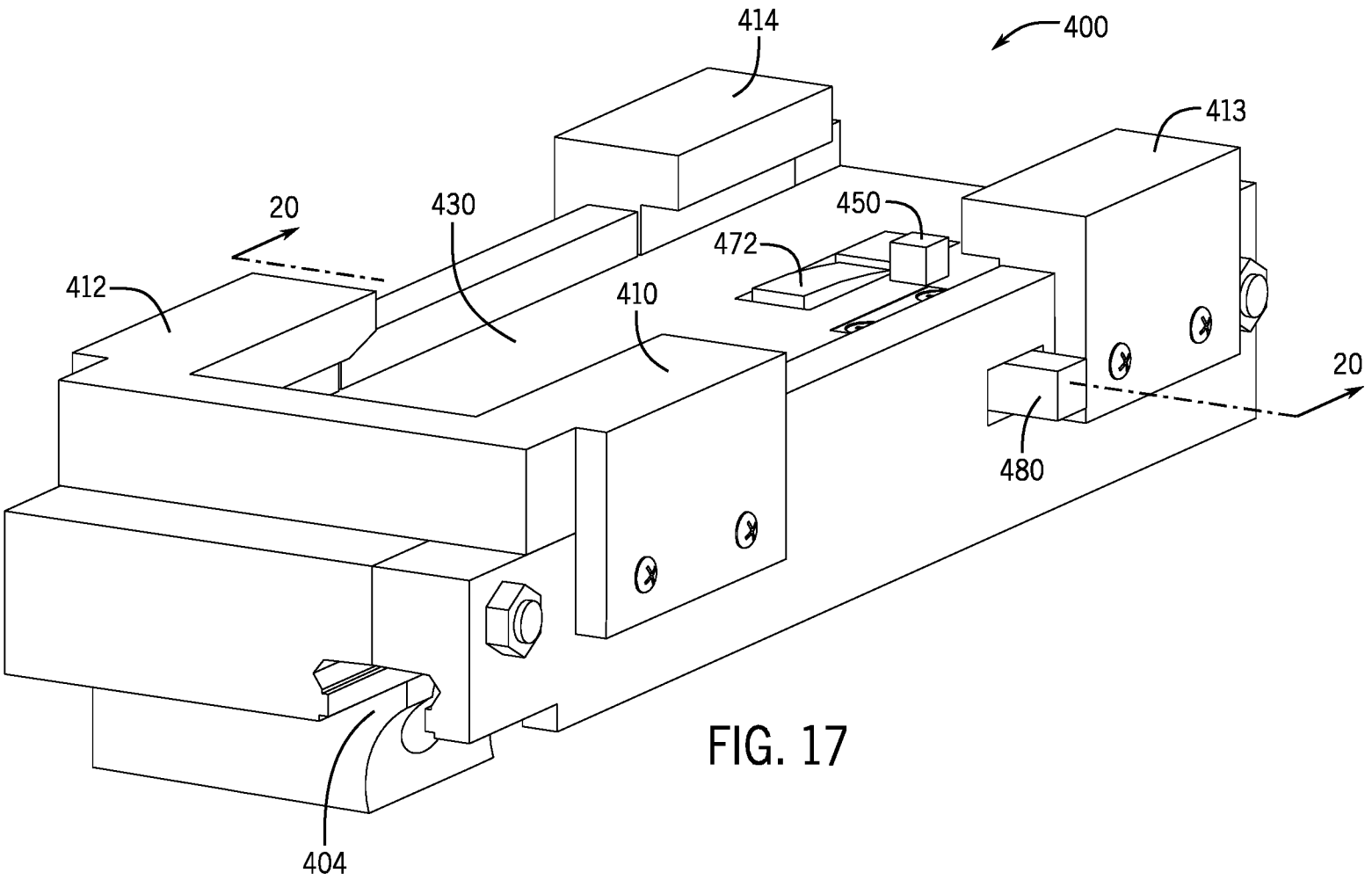
FIG. 17 is a view of the adaptor.
Figure 18:
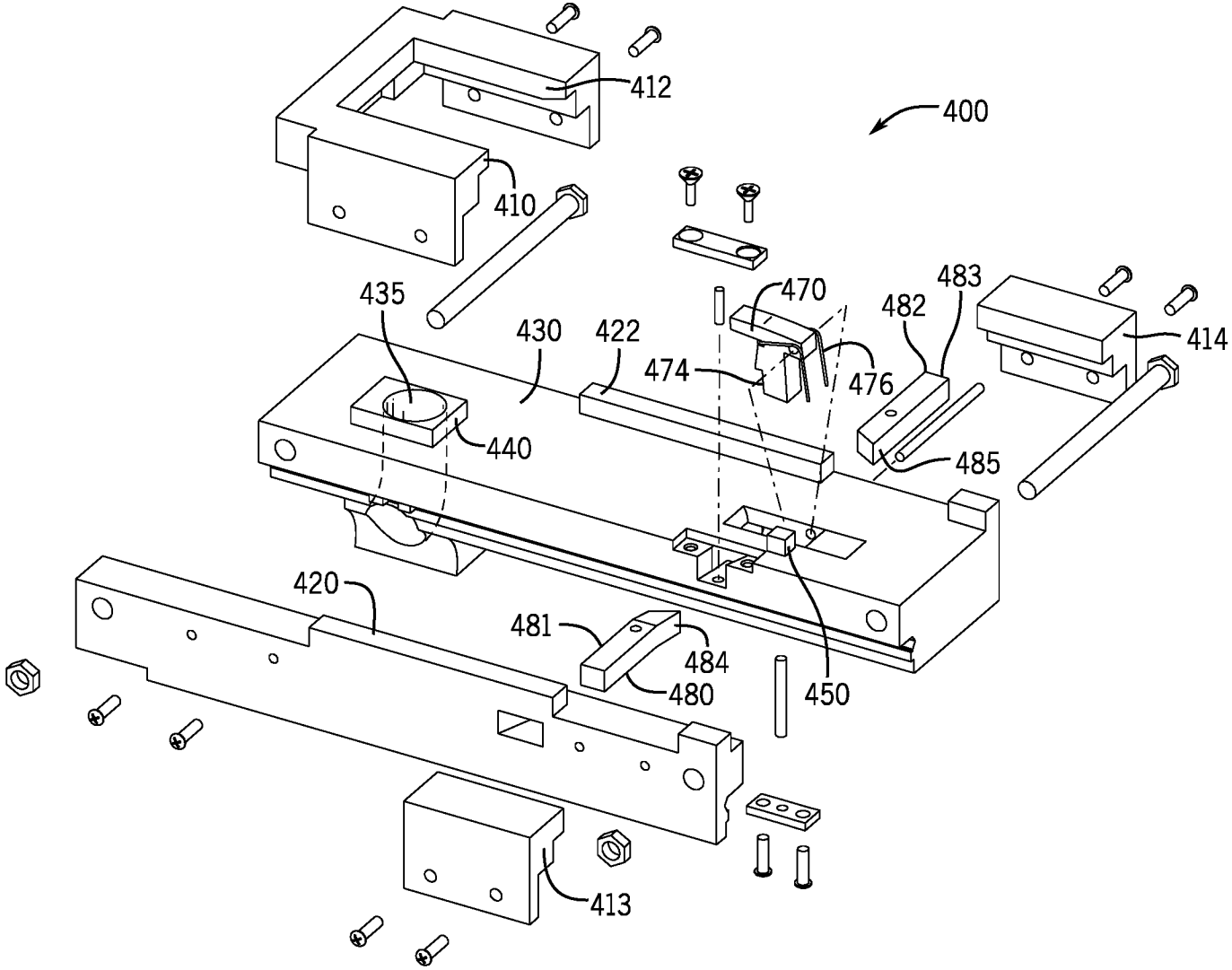
FIG. 18 is an exploded view of the adaptor.
Figure 19:
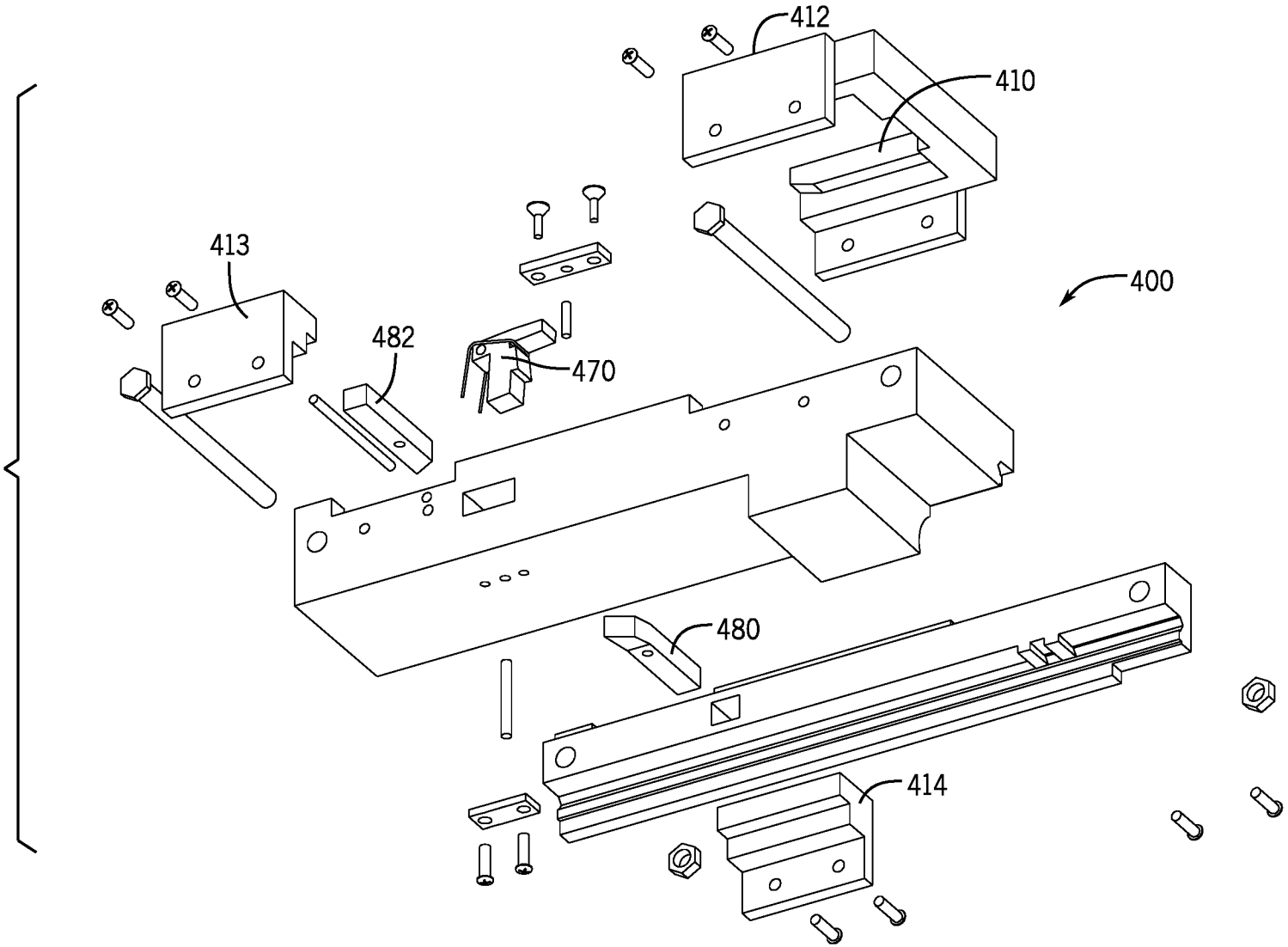
FIG. 19 is an exploded view of the adaptor.
Figure 20:
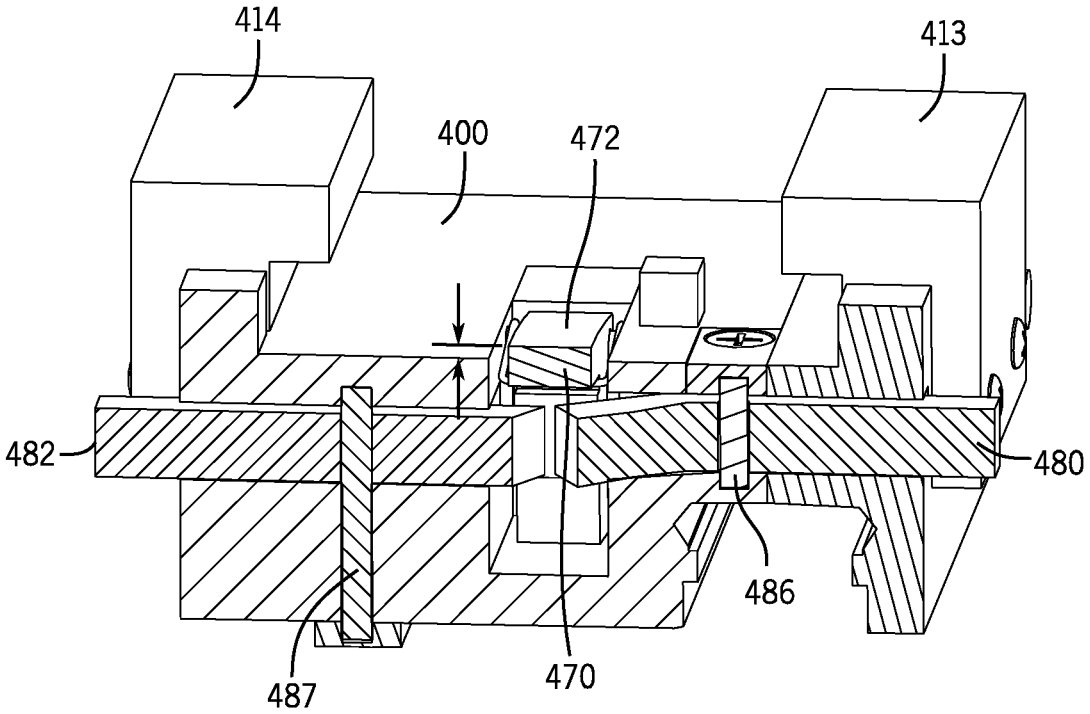
FIG. 20 is a sectional view of the adaptor.
Figure 21:
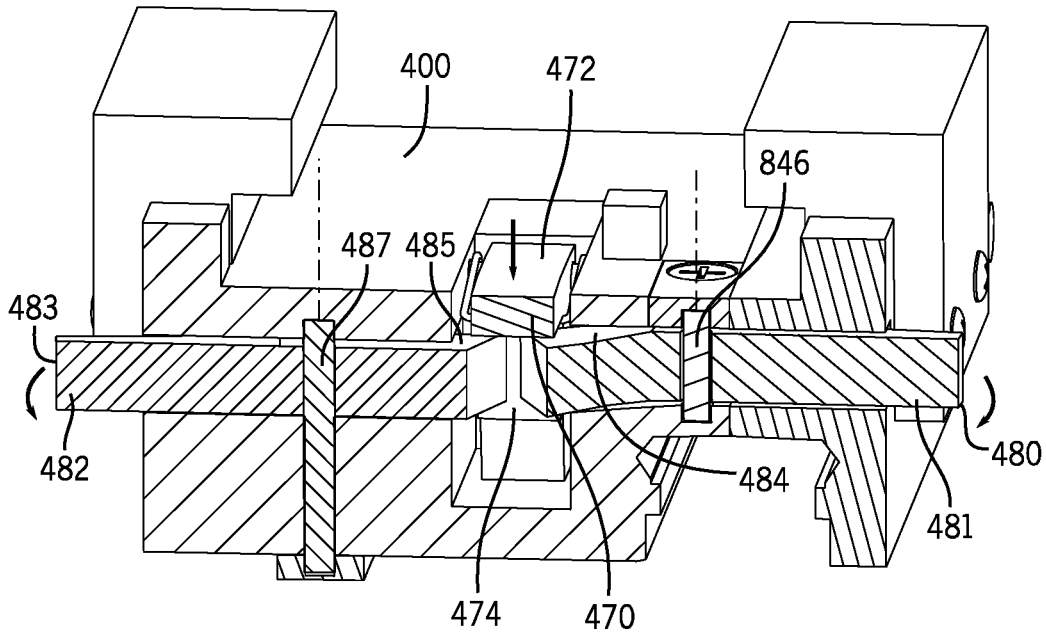
FIG. 21 is a sectional view of the adaptor.
Figure 22:
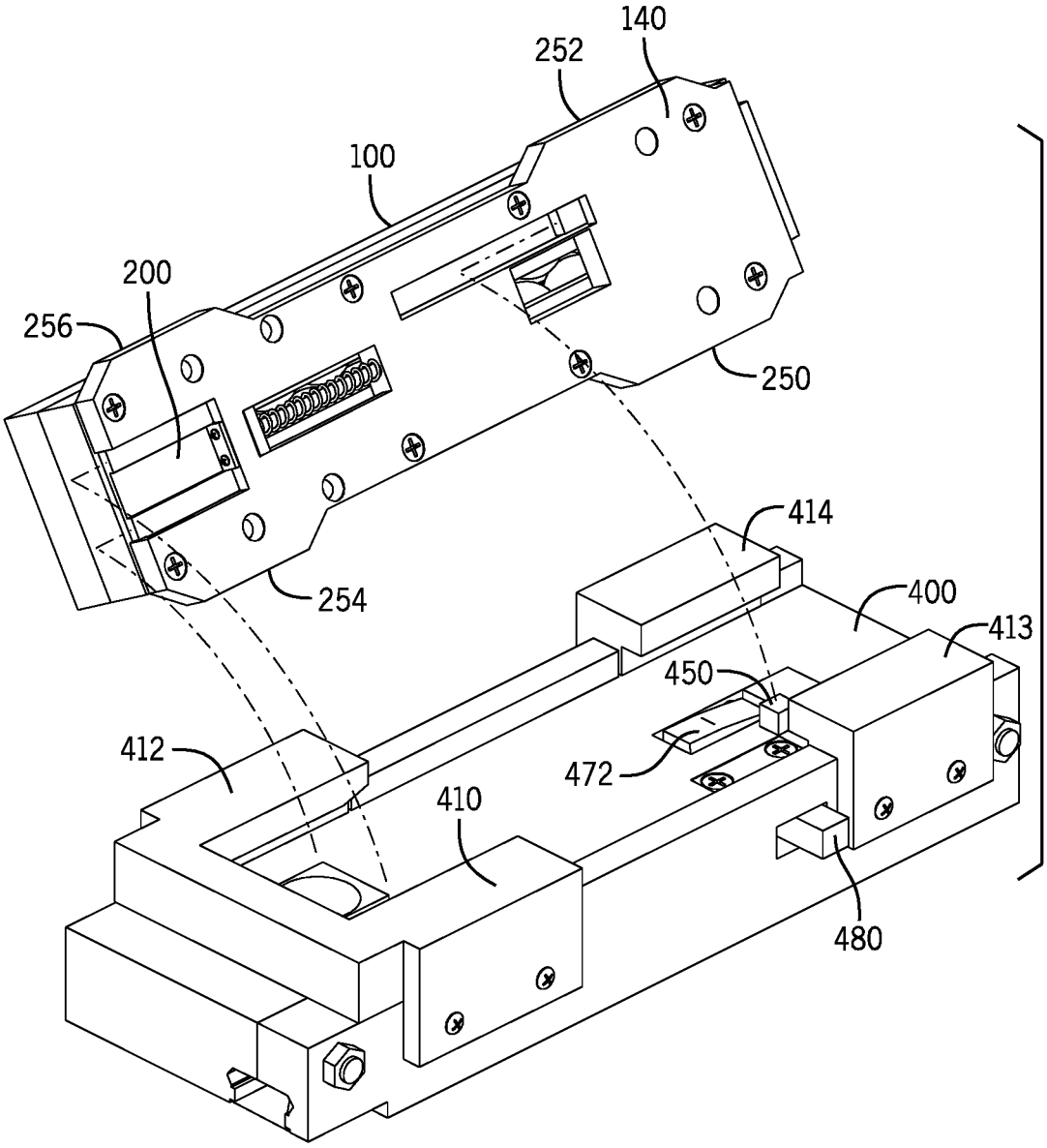
FIG. 22 is a perspective view of the magazine engaging to the adaptor.
Figure 23:
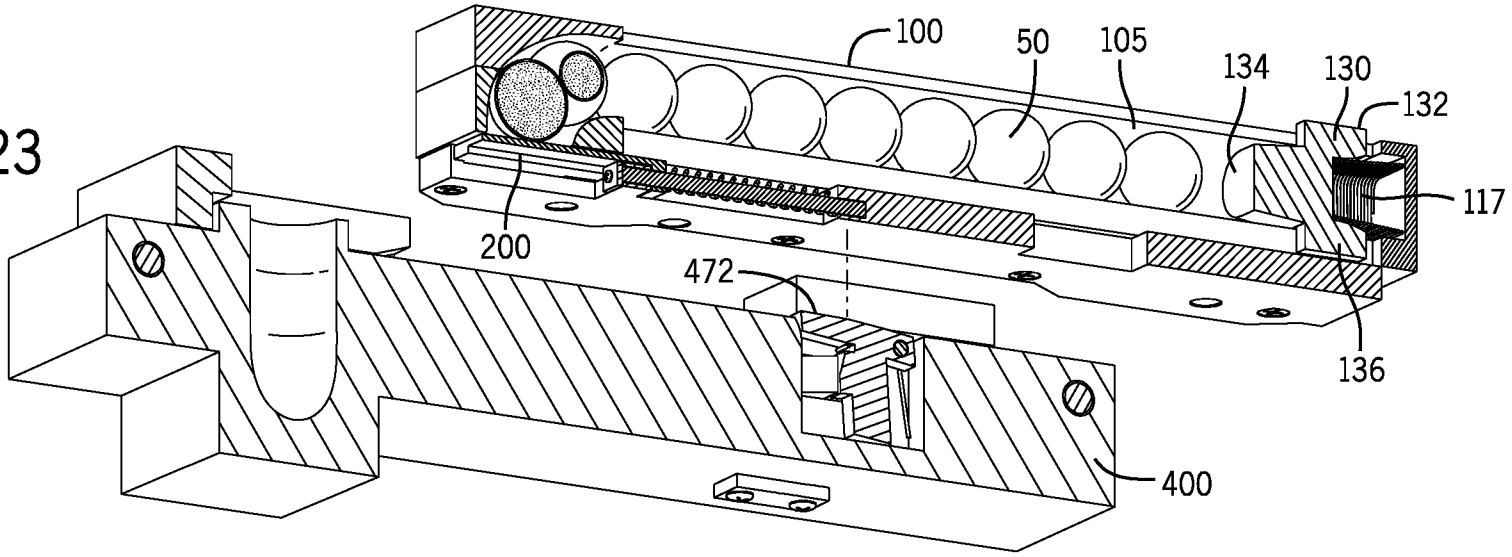
FIG. 23 is a sectional view of the magazine engaging to the adaptor.
Figure 24:
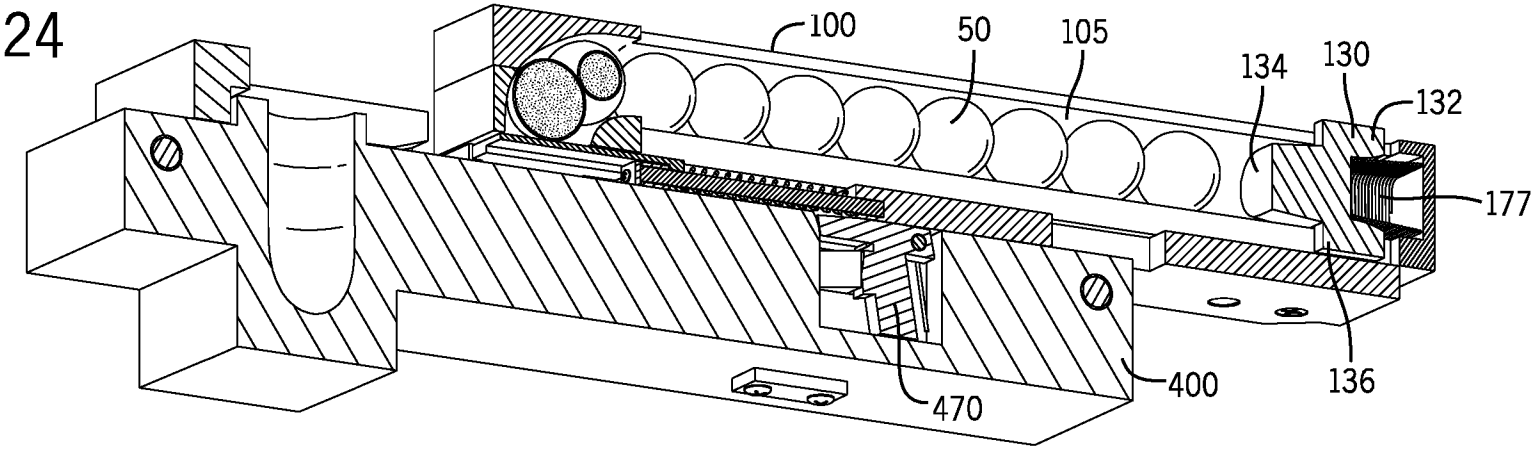
FIG. 24 is a sectional view of the magazine engaging to the adaptor.
Figure 25:
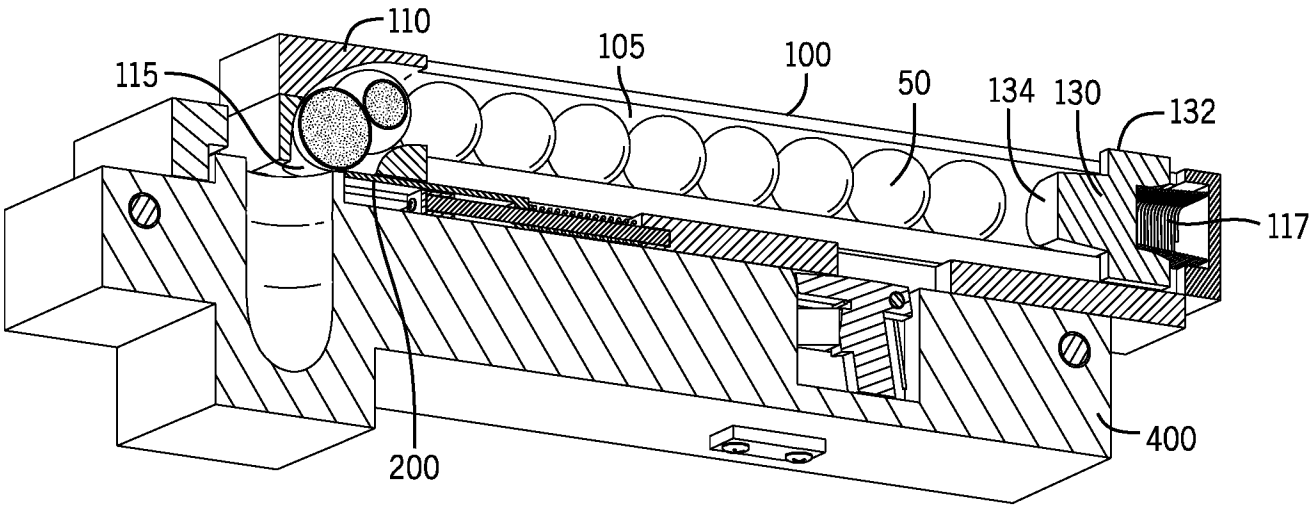
FIG. 25 is a sectional view of the magazine engaging to the adaptor.
Figure 26:
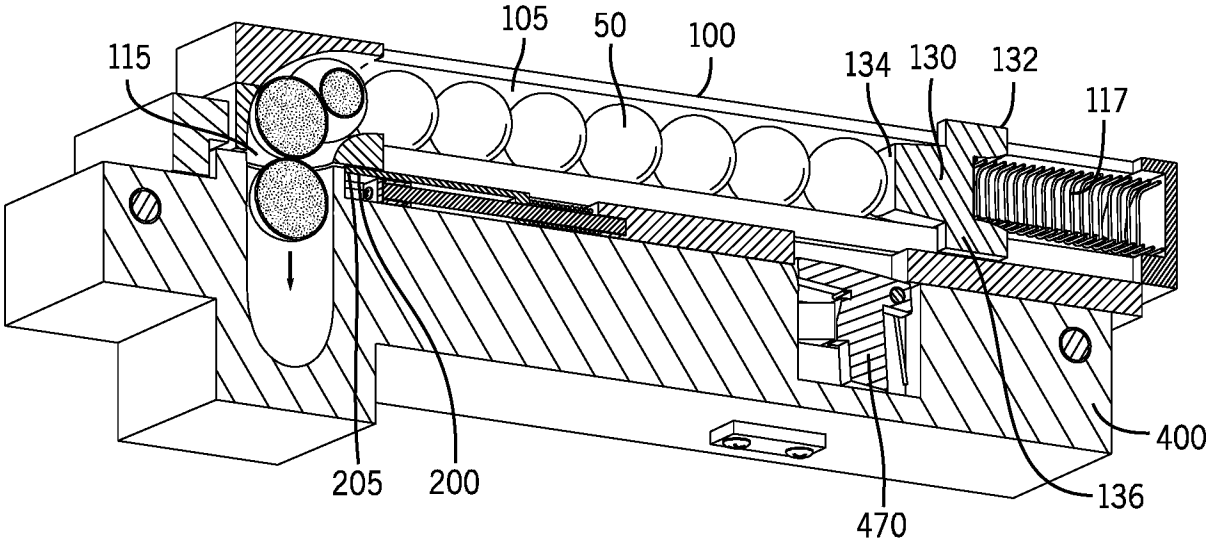
FIG. 26 is a sectional view of the magazine engaging to the adaptor.
Figure 27:
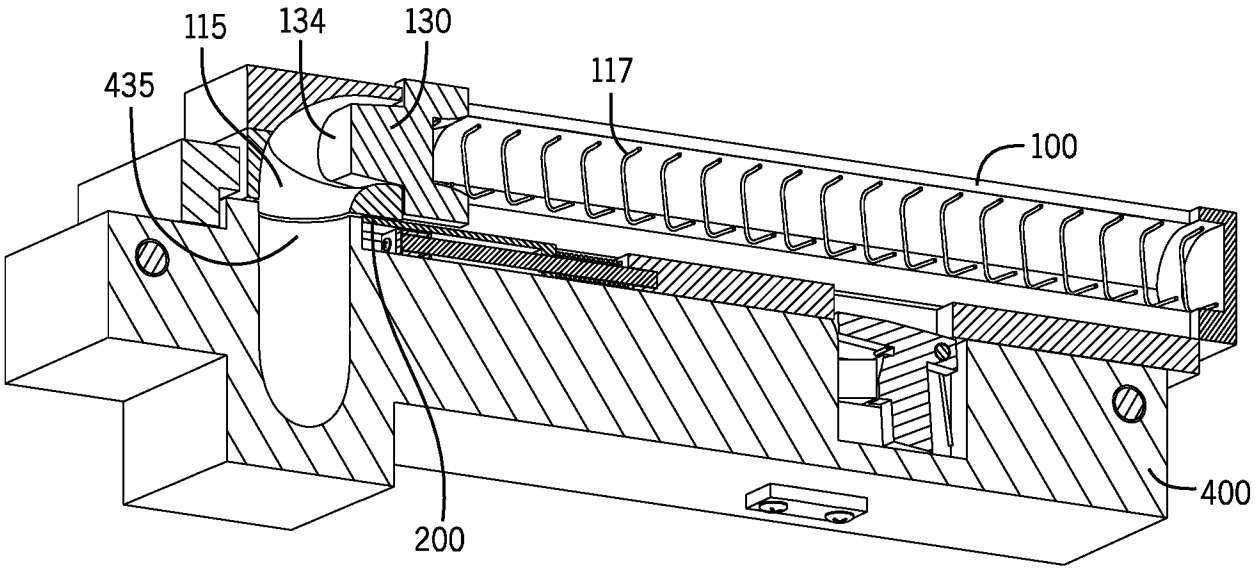
FIG. 27 is a sectional view of the magazine engaging to the adaptor.

With respect to FIGS. 1B and 17, a lower surface 402 of the adaptor 400 is shaped and configured to be complementary to various paintball markers 10. For example, different adaptors 400 may have individualized mating surfaces for specific commercially available paintball markers 10. For example, different adaptors 400 may locate the exit opening 500 in different positions for specific paintball markers 10. In this aspect, the lower surface 402 includes a groove 404 configured to lockingly engage an upper portion 14 of the paintball marker 10.

With respect to FIGS. 23-26, an upper surface 430 of the adaptor 400 includes a raised entry hole 435. The raised entry hole 435 includes walls 440 that contact a front surface 205 of the sliding door 200 of the magazine 100. When the magazine 100 is engaged to the adaptor 400 and the magazine 100 is moved to a forward position, the walls 440 block against the front surface 205 of the sliding door 200 and cause the sliding door 200 to retract, which opens the interior 105 of the magazine 100 and allows flow of the paintballs 50 to the raised entry hole 435, which leads to a feed tunnel 490 of the adaptor 400.

In the loose configuration, the magazine 100 acts as a pod in which paintballs 50 are free to move, rotate, spin, etc. In the loose configuration, the spring-loaded follower 130 has been retracted past a spring-loaded pin 300. In the loose configuration, the spring-loaded pin 300 locks or holds the spring-loaded follower 130 and prevents the spring-loaded follower 130 from moving forward. Thus, the paintballs 50 are free to move around, spin, rotate, etc. within the wide interior 105 of the magazine 100. With reference to FIG. 14, the loose configuration of the magazine 100 is illustrated with the spring-loaded follower 130 in the locked configuration. A lower tab 136 of the spring-loaded follower 130 is behind the spring-loaded pin 300, which holds the spring-loaded follower 130 at the rear of magazine 100. In the loose configuration, the coil spring 117 is held in a retracted position. The spring-loaded pin 300 is biased inward by a spring 302 and obstructs the spring-loaded follower 130 from traveling forward. The spring-loaded pin 300 travels generally perpendicular to the length of the magazine 100.

The upper surface 430 of the adaptor 400 further includes a knob 450, which releases the spring-loaded follower 130. The knob 450 extends upward from the upper surface 430 of the adaptor 400. The knob 450 may include a protuberance, extending member, or other structure that projects upward from the upper surface 430 of the adaptor 400. When the magazine 100 is engaged to the adaptor 400, the knob 450 fits into a channel 142 of the lower wall 140 of the magazine 100. As the magazine 100 is moved to the forward position, the channel 142 moves past the knob 450 and the knob 450 eventually engages a release switch 144 for the spring-loaded follower 130. When the release switch 144 is engaged, the spring-loaded follower 130 is unlocked and drives forward putting bias or tension on the paintballs 50 in the magazine 100. The magazine 100 is now in the tensioned or biased configuration.

The release switch 144 is movably held in or proximate to the channel 142 of the lower wall 140 of the magazine 100. The release switch 144 is biased by a spring 145. The release switch 144 travels parallel to a length of the magazine 100. In this aspect, the release switch 144 is biased forward towards the front of the magazine 100 by the spring 145.

When the magazine 100 is moved forward on the adaptor 400, the knob 450 contacts a front surface 146 of the release switch 144, thus driving the release switch 144 towards the rear of the magazine 100. A rear surface 148 of the release switch 144 eventually contacts and drives against the spring-loaded pin 300, which causes the spring-loaded pin 300 to retract against the bias from the spring 302. When the spring-loaded pin 300 sufficiently retracts to clear the spring-loaded follower 130, the spring-loaded pin 300 may drive forward under the bias of the coil spring 117.

In this aspect, the rear surface 148 of the release switch 144 includes an angled surface which drives against an angled surface of a lower portion 310 of the spring-loaded pin 300. The rear surface 148 of the release switch 144 and the lower portion 310 of the spring-loaded pin 300 may include complementary camming surfaces.

Thus, in the first or tensioned/biased configuration, the spring-loaded follower 130 is unlocked and is free to move under the bias of the coil spring 117 and urge against the paintballs 50. In the second or loose configuration, the spring-loaded follower 130 is locked by the spring-loaded pin 300 and does not urge against the paintballs 50. As described above, the engagement of the magazine 100 (with spring-loaded follower 130 in the locked position) to the adaptor 400 may automatically unlock the spring-loaded follower 130.

When the magazine 100 is disengaged from the adaptor 400, the sliding door 200 may automatically close. As the magazine 100 is move from the forward position to a rear position, the walls 440 of the raised entry hole 435 of the adaptor 400 no longer block against the front surface 205 of the sliding door 200, which permits the sliding door 200 to slide towards the closed position and eventually close. Thus, the paintballs 50 do not pour out of the magazine 100 when the magazine 100 is disengaged from the adaptor 400.

The magazine 100 includes lateral walls 160 and 170, which partially define the interior 105 and the magazine well 108 of the magazine 100. The lateral walls 160 and 170 and extend upward from the middle wall 120 of the magazine 100. The lateral walls 160 and 170 taper inwards towards a front of the magazine 100. As seen in FIG. 7, the lateral walls 160 and 170 include angled portions 162 and 172 that taper inward toward the opening 115. This reduces a width of the interior 105 and a width of the magazine well 108 toward the front of the magazine 100. This inward tapering causes the paintballs 50 to merge from a double-stack arrangement to a single-stack arrangement as the paintballs 50 approach the opening 115. This arrangement reduces delay or lag in the feeding of the paintballs 50 to the paintball marker 10. In the double-stack pattern, adjacent paintballs 50 are generally positioned off-set from each other and are not side-by-side.

In this aspect, the magazine 100 is configured to be used with typical paintballs 50, which have a diameter of approximately 0.68 inches. In this aspect, a majority of the magazine well 108 has a width of approximately 1.0 to approximately 1.2 inches, which is greater than the diameter of the typical paintball. If the width is larger than approximately 1.4 inches, then the paintballs 50 may lodge or jam in the magazine well 108—as the paintballs 50 may stack in a side-by-side fashion. As such, a majority of the magazine well 108 has a width larger than the diameter of the paintball 50 but smaller than double the diameter of the paintball 50. Of course, one of ordinary skill in the art will recognize that the dimensions of the magazine 100 may be varied or scaled depending upon the size of the paintballs 50 or specific paintball marker 10.

As shown in FIG. 7, when the magazine 100 is engaged to the paintball marker 10, the magazine 100 holds the paintballs 50 in a double-stack, alternating (or "zig zag") pattern. The spring-loaded follower 130 urges against the paintballs 50 at the rear of the magazine well 108, which, in turn, causes each paintball 50 to press against the adjacent paintballs 50. For example, with respect to FIG. 7, each paintball 50 presses against a first paintball 50 to its front and a second paint ball to its front lateral side (at an approximate 45 degree angle). This urges the double-stack of paintballs 50 towards the opening 115. The angled portions 162 and 172 taper inward toward the opening 115, which causes the paintballs 50 to merge from the double-stack arrangement into a single-stack arrangement as the paintballs 50 approach the opening 115. The force from the spring-loaded follower 130 is transferred to and from the paintballs 50 to urge the paintballs 50 from the magazine 100 and through the adaptor 400. The force from the spring-loaded follower 130 is transferred to and from the paintballs 50 urges the paintballs 50 through the opening 115, into the raised entry hole 435 of the adaptor 400, down the feed tunnel 490 of the adaptor 400, through the exit opening 500 of the adaptor 400, and to the loading opening 12 of the paintball marker 10. The force or pressure from the spring-loaded follower 130 is transmitted through the adjacent paintballs 50 to feed the paintball marker 10 with paintballs 50 in a rapid and consistent manner.

When the spring-loaded follower 130 is in the loose configuration, the spring-loaded follower 130 is locked in place at a rear of the magazine 100. When the spring-loaded follower 130 is unlocked and is in the tensioned/biased configuration, the spring-loaded follower 130 moves toward the front of the magazine 100. The spring-loaded follower 130 generally travels between the lateral walls 160 and 170. The upper wall 110 generally joins the lateral walls 160 and 170 and closes the interior 105 of the magazine 100. In this aspect, the spring-loaded follower 130 generally travels parallel to a barrel or firing direction of the paintball marker 10.

The magazine 100 includes lateral extending members 250, 252, 254, 256. The lateral extending members 250, 252, 254, 256 extend outward from the magazine 100, i.e., generally perpendicular to the length of the magazine 100. The lateral extending members 250, 252, 254, 256 assist in aligning the magazine 100 to the adaptor 400. When the magazine 100 is engaged to the adaptor 400, the lateral extending members 254 and 256 slide under forward flanges 410 and 412 of the adaptor 400 and lateral extending members 250 and 252 slide under rear flanges 414 and 413 of the adaptor 400. This engagement between the lateral extending members 250, 252, 254, 256 and the flanges 410, 412, 413, and 414 hold the magazine 100 to the adaptor 400 and prevent an upward separating movement of the magazine 100 from the adaptor 400. Lateral walls 420 and 422 of the adaptor 400 are sized to contain the lateral extending members 250, 252, 254, and 256.

Figure 28:
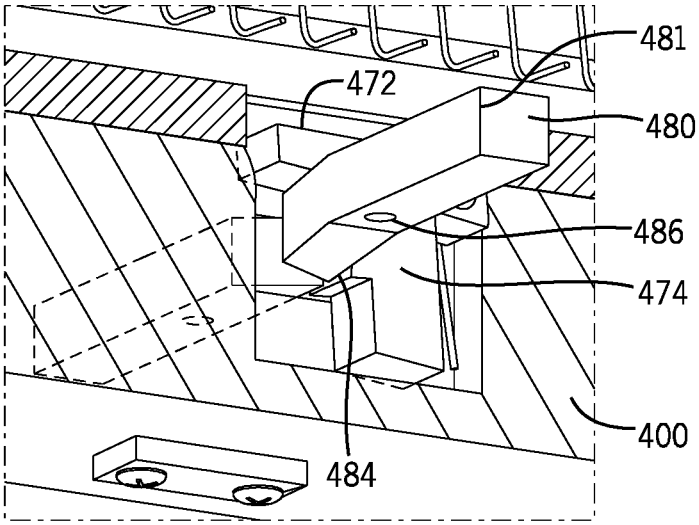
FIG. 28 is a sectional view of the catch mechanism.
Figure 29:
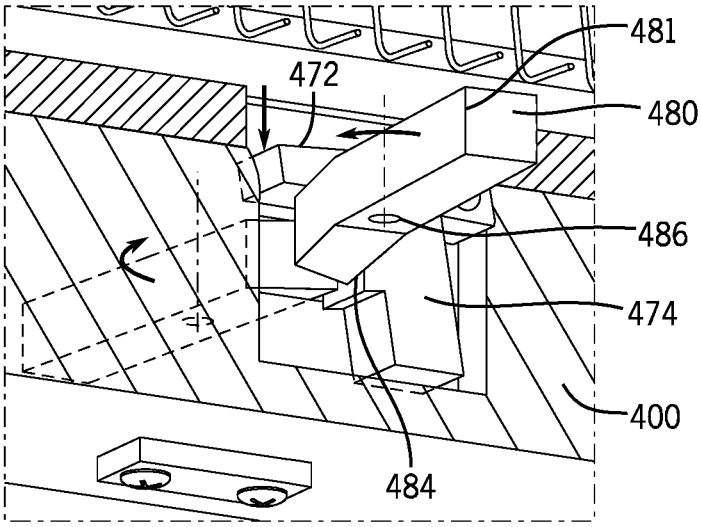
FIG. 29 is a sectional view of the catch mechanism.
Figure 30:
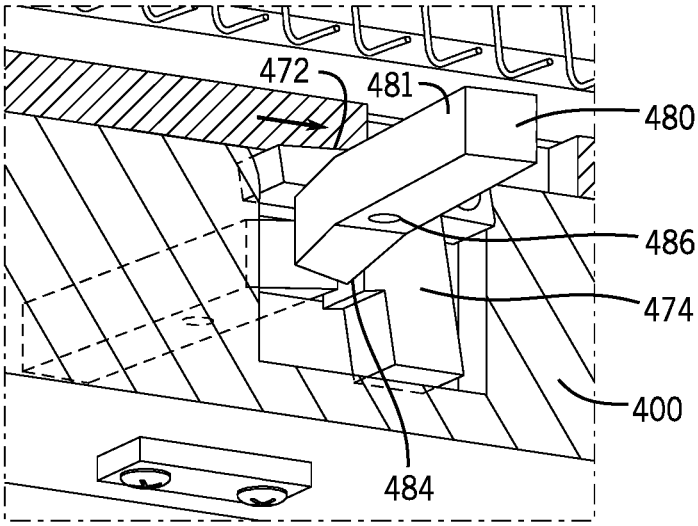
FIG. 30 is a sectional view of the catch mechanism.

With respect to FIGS. 28 and 29, the upper surface 430 of the adaptor 400 further includes a catch mechanism 470, which prevents the disengagement of the magazine 100 from the adaptor 400. When the magazine 100 is moved to the forward position, a contact surface 472 of the catch mechanism 470 lodges in a catch opening 126 in the lower wall 140 of the magazine 100. The catch mechanism 470 is spring-loaded via spring 476, such that the contact surface 472 is urged upward by the spring 476. This engagement between the catch mechanism 470 and the catch opening 126 prevents a lateral separating movement of the magazine 100 from the adaptor 400. In this aspect, either of levers 480 or 482 of the catch mechanism 470 are actuated to release the magazine 100 from the adaptor 400. When either of the levers 480 or 482 are actuated, the contact surface 472 is retracted downward to release from the catch opening 126. Now, the magazine 100 may be slid to the rear position and disengage the lateral extending members 250, 252, 254, and 256 from the forward flanges 410 and the rear flanges 413.

In this aspect, the user of either levers 480 or 482 provide ambidextrous operation. In this aspect, outer portions 481 and 483 of the levers 480 and 482 are pulled or pushed forward, which rotates inner portions 484 and 485 of the levers 480 and 482 backward and against a lower portion 474 of the catch mechanism 470. The contact of the inner portions 484 or 485 against the lower portion 474 overcomes the upward bias of the spring 476 and drives the contact surface 472 of the catch mechanism 470 downward. The levers 480 and 482 rotate about axis 486 and 487, respectively.

The front of the magazine well 108 (at the point of entry into the marker 10) is also vertically contoured to force-feed paintballs into the opening 115 by the combination of the 45 degree angled pressure of the next paintball 50, and the contour of the feed slope of the magazine well 108, working together. The vertically contoured feed slope approaching the opening 115 causes the double-stacked paintballs 50 to quickly move into the opening 115.

Because the follower 130 moves a double-stack of paintballs 50 into a single-stack at the contoured entry to the opening 115, the paintballs 50 are more rapidly moved into the opening 115 than they would be if the follower 130 was pushing only a single stack of paintballs 50.

Before the magazine 100 is engaged to the adaptor 400, the paintballs 50 are free to move around, spin, rotate, etc. within the wide interior 105 of the magazine 100. When the magazine 100 is engaged to the adaptor 400, the spring-loaded follower 130 is released and urges against paintballs 50 to align the paintballs 50 in the double-stack, alternating pattern. The interior 105 and the magazine well 108 are shaped and configured to automatically align the paintballs 50 in the double-stack, alternating pattern upon release of the spring-loaded follower 130. When the spring-loaded follower 130 is released, the spring-loaded follower 130 immediately places tension on the paintballs 50 and assembles the paintballs 50 in the double-stack, alternating pattern. In this aspect, when the spring-loaded follower 130 is released, the spring-loaded follower 130 travels toward the front of the magazine 100.

As such, it should be understood that the disclosure is not limited to the particular aspects described herein, but that various changes and modifications may be made without departing from the spirit and scope of this novel concept as defined by the following claims. Further, many other advantages of applicant's disclosure will be apparent to those skilled in the art from the above descriptions and the claims below.

What is claimed is:

1. A magazine and adapter for a paintball marker, comprising:

a magazine configured to hold paintballs;

an adapter configured to removably engage to a paintball marker;

the magazine configured to engage to the adapter;

the magazine comprised a spring-loaded follower, the spring-loaded follower having a locked configuration and an unlocked configuration, wherein in the locked configuration, the spring-loaded follower is fixed in a position relative to the magazine, and wherein in the unlocked configuration, the spring-loaded follower is configured to move relative to the magazine; wherein an engagement of the magazine in the locked configuration to the adapter transitions the spring-loaded follower to the unlocked configuration;

wherein the magazine includes a magazine well, and the magazine well is contoured to hold paintballs in a double-stack pattern and to urge the paintballs into a single-stack pattern at an exit opening of the magazine; and wherein in the locked configuration, the paintballs are free to move or rotate in the magazine, and wherein in the unlocked configuration, the spring-loaded follower biases the paintballs in the single-stack pattern towards the exit opening of the magazine.

2. The magazine and adapter for a paintball marker according to claim 1, wherein in the locked configuration, the spring-loaded follower does not place tension on the paintballs in the magazine, and wherein in the unlocked configuration, the spring-loaded follower urges the paintballs in the magazine towards the exit opening of the magazine.

3. The magazine and adapter for a paintball marker according to claim 1, wherein a lower surface of the adapter engages an upper portion of the paintball marker in a removable engagement, wherein an upper surface of the adapter comprises a knob, and wherein the knob is configured to release the spring-loaded follower from the locked configuration.

4. The magazine and adapter for a paintball marker according to claim 3, wherein the knob is configured to fit into a channel of a lower wall of the magazine to engage a release switch for the spring-loaded follower to release the spring-loaded follower from the locked configuration.

5. The magazine and adapter for a paintball marker according to claim 4, wherein the engagement of the magazine in the locked configuration to the adapter engages the release switch to release the spring-loaded follower from the locked configuration.

6. The magazine and adapter for a paintball marker according to claim 5, wherein the magazine comprises a spring-loaded pin configured to hold the spring-loaded follower in the locked configuration, and the release switch is configured to retract the spring-loaded pin to unlock the spring-loaded follower from the locked configuration.

7. The magazine and adapter for a paintball marker according to claim 1, wherein the adapter comprises a catch mechanism, wherein the catch mechanism is configured to engage a catch opening in a lower wall of the magazine, wherein the adapter comprises a lever to disengage the catch mechanism from the catch opening.

8. The magazine and adapter for a paintball marker according to claim 1, wherein the magazine includes a sliding door that is configured to retract relative to the magazine to cover and uncover an exit opening of the magazine.

9. The magazine and adapter for a paintball marker according to claim 8, wherein the engagement of the magazine to the adapter causes the sliding door to retract and uncover the exit opening to the magazine.

10. The magazine and adapter for a paintball marker according to claim 8, wherein an upper surface of the adapter includes a raised entry hole, and the raised entry hole includes walls configured to contact a front surface of the sliding door of the magazine.

11. The magazine and adapter for the paintball marker according to claim 1, wherein the magazine includes lateral extending members that extend outward from the magazine, and the lateral extending members are configured to slide under flanges of the adapter when the magazine is engaged to the adapter and moved toward a front of the adapter.

12. The magazine and adapter for a paintball marker according to claim 11, wherein the adapter comprises a catch mechanism, wherein the catch mechanism is configured to engage a catch opening in a lower wall of the magazine, wherein the catch mechanism is configured to prevent the magazine from sliding toward a rear of the adapter.

13. The magazine and adapter for a paintball marker according to claim 1, wherein the magazine comprises an upper wall, a middle wall, and a lower wall, and the upper wall and the middle wall define an interior to hold paintballs, and the lower wall comprises a door configured to cover and uncover an exit opening for the magazine.

14. The magazine and adapter for a paintball marker according to claim 13, wherein the lower wall houses a switch that actuates a spring-loaded pin to release a spring-loaded follower from the locked configuration.

15. The magazine and adapter for a paintball marker according to claim 1, wherein in the unlocked configuration, the magazine aligns the paintballs in a double-stack, alternating pattern.

16. The magazine and adapter for a paintball marker according to claim 15, wherein the magazine merges the double-stack, alternating pattern into a single-stack pattern as the paintballs approach the exit opening of the magazine.

17. The magazine and adapter for a paintball marker according to claim 16, wherein the paintballs pass through a feed tunnel of the adapter in a single-stack pattern.

18. The magazine and adapter for a paintball marker according to claim 1, wherein lateral walls of the magazine taper inwards towards a front of the magazine.

19. The magazine and adapter for a paintball marker according to claim 1, wherein the magazine well is horizontally contoured, and the magazine well is vertically contoured at the exit opening.

20. The magazine and adapter for a paintball marker according to claim 1, wherein the magazine well is horizontally contoured, and a front of the magazine well is vertically contoured.

21. The magazine and adapter for a paintball marker according to claim 1, wherein a lower surface of the adapter engages an upper portion of the paintball marker in a removable engagement.

22. The magazine and adapter for a paintball marker according to claim 1, wherein a lower surface of the adapter includes a groove configured to lockingly engage an upper portion of the paintball marker.

23. A magazine and adapter for a paintball marker, comprising:

a magazine configured to hold paintballs;

an adapter configured to removably engage to a paintball marker;

the magazine configured to engage to the adapter;

the magazine comprised a spring-loaded follower, the spring-loaded follower having a locked configuration and an unlocked configuration, wherein in the locked configuration, the spring-loaded follower is fixed in a position relative to the magazine, and wherein in the unlocked configuration, the spring-loaded follower is configured to move relative to the magazine; wherein an engagement of the magazine in the locked configuration to the adapter transitions the spring-loaded follower to the unlocked configuration;

wherein the magazine includes a magazine well, and the magazine well is contoured to hold paintballs in a double-stack pattern and to urge the paintballs into a single-stack pattern at an exit opening of the magazine;

wherein in the locked configuration, the paintballs are free to move or rotate in the magazine, and wherein in the unlocked configuration, the spring-loaded follower biases the paintballs in the single-stack pattern towards the exit opening of the magazine, and wherein the magazine is horizontally contoured, wherein an interior width of the magazine is greater than a diameter of the paintballs and less than double the diameter of the paintballs.

24. A magazine and adapter for a paintball marker, comprising:

a magazine configured to hold paintballs;

an adapter configured to removably engage to a paintball marker;

the magazine configured to engage to the adapter;

the magazine comprised a spring-loaded follower, the spring-loaded follower having a locked configuration and an unlocked configuration, wherein in the locked configuration, the spring-loaded follower is fixed in a position relative to the magazine, and wherein in the unlocked configuration, the spring-loaded follower is configured to move relative to the magazine; wherein an engagement of the magazine in the locked configuration to the adapter transitions the spring-loaded follower to the unlocked configuration;

wherein the magazine includes a magazine well, and the magazine well is contoured to hold paintballs in a double-stack pattern and to urge the paintballs into a single-stack pattern at an exit opening of the magazine;

wherein in the locked configuration, the paintballs are free to move or rotate in the magazine, and wherein in the unlocked configuration, the spring-loaded follower biases the paintballs in the single-stack pattern towards the exit opening of the magazine, and wherein the spring-loaded follower travels parallel to a barrel or a firing direction of the paintball marker.

25. A magazine and adapter for a paintball marker, comprising:

a magazine configured to hold paintballs;

an adapter configured to removably engage to a paintball marker;

the magazine configured to engage to the adapter;

the magazine comprised a spring-loaded follower, the spring-loaded follower having a locked configuration and an unlocked configuration, wherein in the locked configuration, the spring-loaded follower is fixed in a position relative to the magazine, and wherein in the unlocked configuration, the spring-loaded follower is configured to move relative to the magazine; wherein an engagement of the magazine in the locked configuration to the adapter transitions the spring-loaded follower to the unlocked configuration;

wherein the magazine includes a magazine well, and the magazine well is contoured to hold paintballs in a double-stack pattern and to urge the paintballs into a single-stack pattern at an exit opening of the magazine;

wherein in the locked configuration, the paintballs are free to move or rotate in the magazine, and wherein in the unlocked configuration, the spring-loaded follower biases the paintballs in the single-stack pattern towards the exit opening of the magazine, and wherein the paintballs pass through the exit opening of the magazine and into an entry hole of the adapter, down a feed tunnel of the adapter, through an exit opening of the adapter, and to a loading opening of the paintball marker.

* * * * *